US006224317B1

(12) United States Patent
Kann et al.

(10) Patent No.: US 6,224,317 B1
(45) **Date of Patent: *May 1, 2001**

(54) FRONT END LOADER ADAPTER

(75) Inventors: Dirk C. Kann, deceased, late of Guttenberg, by Rose E. Kann, legal representative; Virgil L. Collins, Guttenberg, both of IA (US); Richard T. Williams, Lewis Center, OH (US)

(73) Assignee: Kann Manufacturing Corporation, Guttenberg, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/455,684

(22) Filed: Dec. 7, 1999

Related U.S. Application Data

(63) Continuation-in-part of application No. 09/001,283, filed on Dec. 31, 1997, now Pat. No. 6,027,299.

(51) Int. Cl.[7] ..... B65F 3/04
(52) U.S. Cl. ..... 414/408; 414/406; 414/810
(58) Field of Search ..... 414/406, 407, 414/408, 810

(56) References Cited

U.S. PATENT DOCUMENTS

| | | |
|---|---|---|
| 2,738,222 | 3/1956 | Needham . |
| 2,807,383 | 9/1957 | Scheltens . |
| 2,824,658 | 2/1958 | Beasley . |
| 2,828,032 | 3/1958 | Beasley et al. . |
| 3,013,684 | 12/1961 | King et al. . |
| 3,015,401 | 1/1962 | Bergstrom . |
| 3,207,345 | 9/1965 | Ord . |
| 3,613,924 | 10/1971 | Monson . |
| 3,661,285 | 5/1972 | Appleman . |

(List continued on next page.)

FOREIGN PATENT DOCUMENTS

| | | | | |
|---|---|---|---|---|
| 1241345 | * | 5/1967 | (DE) | 414/406 |
| 1269943 | * | 6/1968 | (DE) | 414/406 |
| 2523186 | | 10/1975 | (DE) | 414/406 |
| 149850 | | 8/1981 | (DE) | 414/406 |

*Primary Examiner*—Thomas J. Brahan
(74) *Attorney, Agent, or Firm*—Foley & Lardner

(57) ABSTRACT

A refuse collection vehicle is disclosed for loading refuse from a front loading container having a floor, a front wall, a rear wall, first and second side walls and first and second channels along the first and second side walls, and also from a rear loader container having a floor, a front wall, a rear wall, first and second side walls and at least one trunnion having first and second trunnion end portions extending beyond the first and second side walls, respectively. The collection vehicles includes a chassis, a storage body supported by the chassis and having an interior with a roof above the interior providing an opening into the interior and first and second lift arms pivotably coupled to the chassis. The refuse collection vehicle further includes a loader adapter coupled to the first and second lift arms. The loader adapter includes first and second forks, first and second trunnion encircling mechanisms, at least one support arm and at least one container stop. The loader adapter is configured to move between a front loader position in which the adapter is adapted to engage the front loading container and a rear loader position in which the adapter is adapted to engage the rear loading container. In the front loader position, the first and second forks are adapted to be disposed in the first and second channels. In the rear loader position, the first and second encircling members are adapted to encircle the first and second trunnion end portions. In the rear loader position, the support arm is adapted to engage the rear wall of the rear loading container and the at least one container stop is adapted to engage an upper edge of at least one of the first and second side walls of the rear loading container.

33 Claims, 13 Drawing Sheets

U.S. PATENT DOCUMENTS

| | | | | |
|---|---|---|---|---|
| 3,702,662 | * | 11/1972 | Davieau | 414/406 |
| 3,713,556 | | 1/1973 | Tredray . | |
| 3,752,346 | | 8/1973 | Thompson et al. . | |
| 3,790,011 | | 2/1974 | Owen, Jr. . | |
| 3,797,684 | | 3/1974 | Brandt . | |
| 3,809,270 | | 5/1974 | Peltonen . | |
| 3,931,901 | * | 1/1976 | Jones | 414/406 |
| 4,613,271 | | 9/1986 | Naab . | |
| 4,687,405 | | 8/1987 | Olney . | |
| 5,074,737 | | 12/1991 | Pellegrini et al. . | |
| 5,266,000 | | 11/1993 | LeBlanc, Jr. . | |
| 5,433,493 | | 7/1995 | Dix et al. . | |
| 6,027,299 | * | 2/2000 | Williams | 414/408 |

* cited by examiner

10

458
458
456
454
23
472
456
70
474
474
466
462
462
466
412
464
464
504
504
23

10

458
458
520
520
456
472
456
466
462
462
466
412
464
464
148
504
504

FRONT END LOADER ADAPTER

CROSS-REFERENCE TO RELATED APPLICATIONS

The present application is a continuation-in-part application of U.S. application Ser. No. 09/001,283 filed on Dec. 31, 1997 now U.S. Pat. No. 6,027,299 by Richard T. Williams and entitled ADAPTER AND METHODS FOR EMPTYING REAR END LOADING WASTE CONTAINERS USING FRONT LOADING WASTE VEHICLES, the full disclosure of which is hereby incorporated by reference.

FIELD OF THE INVENTION

The present invention relates to refuse collection vehicles. In particular, the present invention relates to a refuse collection vehicle having an adapter for enabling the refuse collection vehicle to engage and load refuse from rear loading containers having trunnions or front loading containers having side pockets or channels.

BACKGROUND OF THE INVENTION

Refuse today may be placed in any one of a variety of different containers. Businesses and apartment complexes typically employ either a "front end loader" (FEL) waste container or a "rear end loader" (REL) waste container. FEL waste containers generally include channels or pockets built into the sides of the waste container. The collection of refuse from FEL waste containers has typically required a specialized refuse collection vehicle having a pair of spaced forks supported by a pair of lifting arms. To engage and unload the FEL container, the fork must be inserted into the channels and the lift arm must be actuated to lift and invert the FEL container over an opening communicating with an interior storage compartment of the vehicle.

In contrast, to load refuse from REL containers requires a specialized collection vehicle having a lower back-end configured to engage each end of the trunnion and a cable at the rear of the vehicle configured to be connected to a top rear portion of the REL container. A motorized winch on the vehicle is then used to pull and lift the REL container off of the ground while the body of the REL container pivots about the trunnion and empties its contents into the rear of the vehicle. In lieu of the winch and cable, some refuse collection vehicles utilize a hydraulic lifting apparatus configured to engage the wall of the REL container and to lift and rotate the container about the trunnions into a dumping position. Unfortunately, refuse collection vehicles configured to unload refuse from FEL containers are not presently capable of also unloading refuse from REL containers. Likewise, refuse collection vehicles configured for unloading refuse from REL containers are not capable of also unloading refuse from REL containers. As a result, waste hauling companies are forced to maintain a large inventory of both types of waste vehicles and an equally large inventory of FEL and REL containers. Maintaining such a large inventory of vehicles and containers is expensive and inconvenient. Adding FEL pockets to a REL container requires modifying each container which is also expensive and inconvenient.

Thus, there is a continuing need for a refuse collection vehicle capable of unloading refuse from both FEL and REL containers. There is also a continuing need for an adapter to enable an existing front end loader of refuse collection vehicle to unload refuse from REL waste containers.

SUMMARY OF THE INVENTION

The present invention provides a refuse collection vehicle for loading refuse from a front loading container having a floor, a front wall, a rear wall, first and second side walls, and first and second channels along the first and second side walls and also from a rear loading container having a floor, a front wall, a rear wall, first and second side walls and at least one trunnion having first and second end portions extending beyond the first and second side walls, respectively. The vehicle includes a chassis, a storage body supported by the chassis and having an interior with a roof above the interior providing an opening into the interior, first and second lift arms pivotably coupled to one of the chassis and the storage body, a cross member extending between the first and second lift arms, first and second forks extending from the cross member and configured to be positioned within the first and second channels, at least one support arm configured to engage the rear wall of the rear loading container, at least one movable surface adapted for movement between a first trunnion encircling position and a second trunnion non-encircling position, and at least one movable container stop surface adapted for movement between an extended position and a retracted position. In the extended position, the stop surface engages an upper edge of one of the first and second side walls of the rear loading container. In the retracted position, the at least one movable container stop permits the first and second forks to be positioned within the first and second channels.

The present invention provides a refuse collection vehicle for loading refuse from a front loading container having a floor, a front wall, a rear wall, first and second side walls and first and second channels along the first and second side walls, and also from a rear loader container having a floor, a front wall, a rear wall, first and second side walls and at least one trunnion having first and second trunnion end portions extending beyond the first and second side walls, respectively. The collection vehicle includes a chassis, a storage body supported by the chassis and having an interior with a roof above the interior providing an opening into the interior and first and second lift arms pivotably coupled to one of the chassis and the storage body. The refuse collection vehicle further includes a loader adapter coupled to the first and second lift arms. The loader adapter includes first and second forks, first and second trunnion encircling mechanisms, at least one support arm and at least one container stop. The loader adapter is configured to move between a front loader position in which the adapter is adapted to engage the front loading container and a rear loader position in which the adapter is adapted to engage the rear loading container. In the front loader position, the first and second forks are adapted to be disposed in the first and second channels. In the rear loader position, the first and second encircling members are adapted to encircle the first and second trunnion end portions. In the rear loader position, the support arm is adapted to engage the rear wall of the rear loading container and the at least one container stop is adapted to engage an upper edge of at least one of the first and second side walls of the rear loading container.

The present invention provides an adapter for use with a refuse collection vehicle to load refuse from a container having a floor, a front wall, a rear wall, first and second side walls, and at least one trunnion having first and second trunnion end portions extending beyond the first and second side walls, respectively. The adapter is for use with a refuse collection vehicle having a chassis, a storage body supported by the chassis and including an interior with a roof above the interior providing an opening into the interior, and first and second lift arms pivotally coupled to the chassis of the body. The adapter includes a cross member configured to be coupled to the first and second lift arms between the first and second lift arms, at least one support arm supported by the cross member and configured for pivotable movement between a container-engaging position in which the at least one support arm is adapted to engage the rear wall of the container and a retracted position, at least one moveable surface supported by the cross member and adapted for movement between a trunnion encircling position and a trunnion non-encircling position, and at least one moveable container stop surface supported by the cross member and configured to engage an upper edge of one of the first and second side walls of the container.

The present invention also provides a refuse collection vehicle for loading refuse from a container having a floor, a front wall, a rear wall, first and second side walls having first and second upper edges, respectively, and at least one trunnion proximate the rear wall, the at least one trunnion having first and second end portions extending beyond the first and second side walls, respectively. The vehicle includes a chassis, a storage body supported by the chassis, first and second lift arms pivotably coupled to the chassis or body, a cross member extending between the first and second lift arms, at least one support arm configured to engage the rear wall of the container, at least one movable member adapted for movement between a first trunnion encircling position and a second trunnion non-encircling position and at least one container stabilizer extending from the cross member and configured to engage at least one of the upper edge of the first side wall, the upper edge of the second side wall and the front wall.

The present invention also provides a method of picking up and emptying a refuse container having a floor, a front wall, a rear wall, first and second side walls having first and second upper edges, respectively, and at least one trunnion having first and second end portions extending beyond the first and second side walls, respectively. The method includes providing a refuse collection vehicle having at least one waste collection compartment having a roof with a load opening therethrough, a lifting assembly including a cross member connected to hydraulic arms, at least one movable member adapted for movement between a first trunnion encircling position and a second trunnion non-encircling position, at least one support arm configured to engage the rear wall of the container and at least one movable container stop adapted for movement between a retracted position and an extended position in which the stop engages at least one of the upper edge of the first side wall, the upper edge of the second side wall and the front wall. The method also includes moving the at least one movable member to the first trunnion encircling position, moving the at least one support arm into engagement with the rear wall of the container, moving the at least one container stop into engagement with at least one of the upper edge of the first side wall, the upper edge of the second side wall and the front wall of the container, and pivoting the hydraulic arm to lift and at least partially invert the container over the roof of the waste collection compartment and in at least partial alignment with the load opening.

DETAILED DESCRIPTION OF THE PREFERRED EMBODIMENTS

Figure 1:
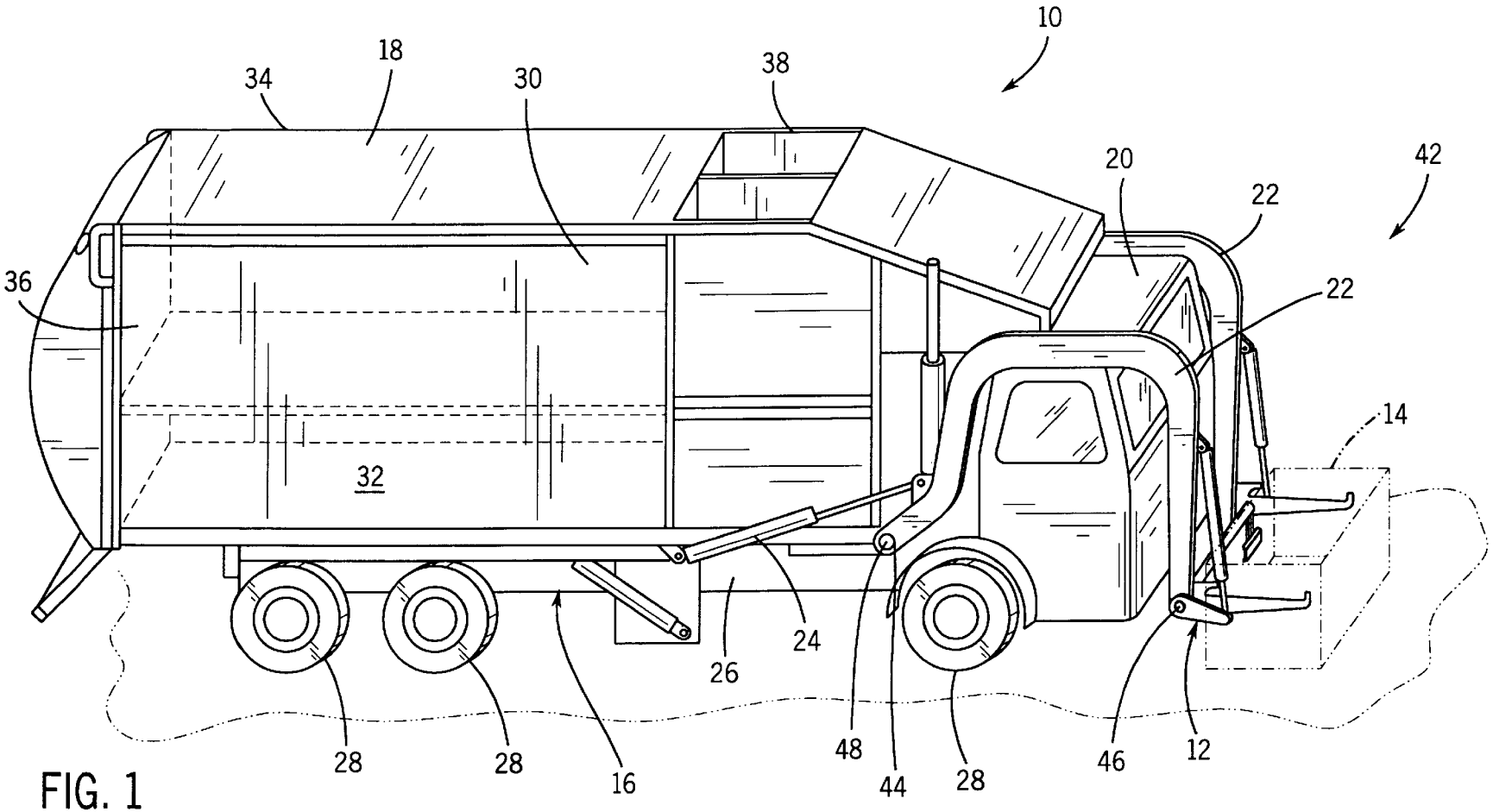
FIG. 1 is a front perspective view of a refuse collection vehicle including an exemplary front loading adapter system of the present invention engaging a waste container.

FIG. 1 is a front perspective view of refuse collection vehicle 10 including front loading adapter system 12 engaging a rear end loader (REL) waste container (shown in phantom). Refuse collection vehicle 10 generally includes chassis 16, storage body 18, cab 20, lift arm 22, and lift arm actuators 24. Chassis 16 is conventionally known and generally includes frame 26 and wheels 28 which carry and support storage body 18, cab 20, lift arms 22, actuators 24 and adapter system 12, as well as a conventional engine, transmission, hydraulic system and control system of vehicle 10 (not shown).

Storage body 18 is generally disposed rearwardly of cab 20 upon chassis 16 and includes a plurality of walls defining an interior 30 having a floor 32, a roof 34, a rearward discharge opening 36 and an upper load opening 38 extending through roof 34 and in communication with interior 30. In the exemplary embodiment, refuse collection vehicle 10 additionally includes compactor rams situated for compacting refuse within interior 30 of storage body 18. A more detailed description of storage body 18 is set forth in U.S. Pat. No. 5,769,501, assigned to Kann Manufacturing Corporation, the full disclosure of which is hereby incorporated by reference. Although adapter system 12 is illustrated for use with storage body 18 which is specifically configured for segregating refuse into different compartments, adapter system 12 may alternatively be used on a variety of differently configured refuse collection vehicles which may also have multiple compartments or which may merely provide a single compartment.

Cab 20 is disposed forward to storage body 18 and is conventionally known. Cab 20 provides an operator station and also houses a majority of the controls for controlling the engine, transmission and hydraulic system of refuse collection vehicle 10.

Lift arms 22 extend at a forward end 42 of vehicle 10 and each include a first end 44 pivotably coupled to chassis 16 and a second end 46 coupled to adapter system 12. Alternatively, first end 44 may be pivotally coupled to body 18 or other structural components of vehicle 10. Lift arms 22 are further coupled to lift arm actuators 24.

Lift arm actuators 24 comprise conventionally known hydraulic piston-cylinder assemblies coupled between chassis 16 and each of lift arms 22 as well as the hydraulic system and control system of work vehicle 10. Alternatively, actuators 24 may be coupled between storage body 18 and lift arms 22. In response to control signals from the control system, the hydraulic system extends and retracts actuators 24 to pivot lift arms 22 about axis 48 to raise and lower adapter system 12 and an engaged refuse container, such as container 14.

Adapter system 12 mounts to forward end 42 of refuse collection vehicle 10 between lift arms 22. Adapter system 12 is configured to move between a front end loader (FEL) position in which adapter system 12 is oriented so as to project into and engage each of the opposing side channels of a FEL container and a rear end loader (REL) position in which adapter system 12 is oriented so as to encircle opposing ends of a trunnion of a REL container. Once the container has been engaged, actuators 24 are actuated to pivot lift arms 22 about axis 48 to lift and elevate the container over and above opening 38 for unloading refuse from the container through opening 38 into interior 30 of storage body 18. In the exemplary embodiment illustrated, actuators 24 and lift arms 22 are configured to invert the container during unloading. Alternatively, actuators 24 and lift arms 22 may be configured to simply position the container over opening 38 whereby the floor of the container is opened to unload refuse through opening 38 into interior 30. Because adapter system 12 is configured to engage and unload refuse from both FEL containers and REL containers by simply changing the orientation of adapter system 12, refuse collection vehicle 10 is more versatile in that it can handle both types of containers. As a result, adapter system 12 eliminates the need for companies to maintain large inventories of different types of refuse collection vehicles as well as different types of refuse collection containers. Adapter system 12 also enables existing refuse collection vehicles, previously configured to only handle FEL containers, to be modified to also handle REL containers.

Figure 2:
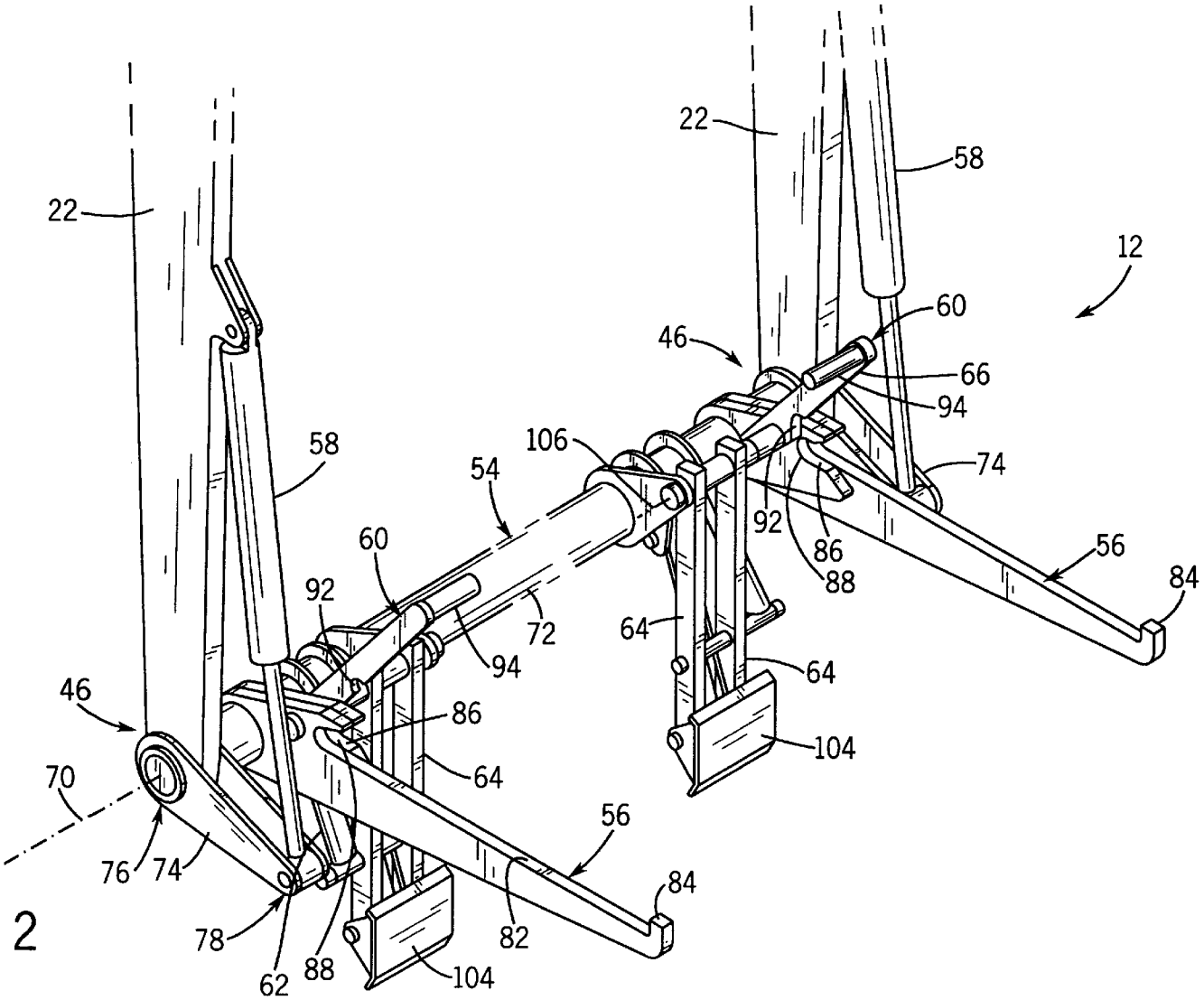
FIG. 2 is an enlarged perspective view of the adapter system shown in FIG. 1 omitting the waste container.
Figure 3:
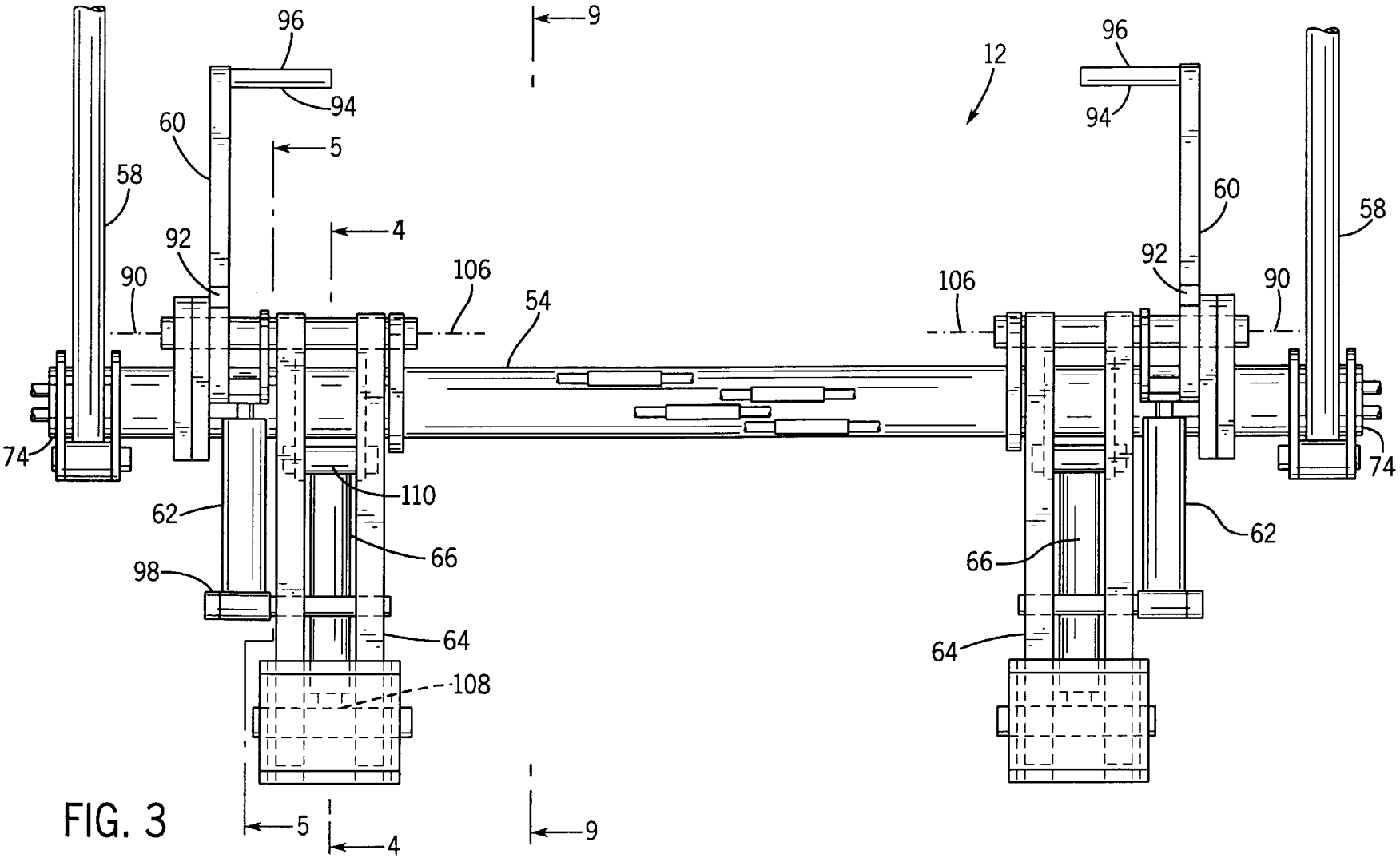
FIG. 3 is a front elevational view of the adapter system of FIG. 2.

FIGS. 2 and 3 illustrate adapter system 12 in greater detail. Adapter system 12 generally includes cross member or cross support 54, forks 56, actuators 58, lock arms 60, lock arm actuators 62, support arms 64 and support arm actuators 66. Cross support 54 extends between and is pivotably coupled to ends 46 of lift arms 22 for rotation about axis 70. Cross support 54 includes a central tube or shaft 72 and a pair of opposing forwardly extending ears 74. Central shaft 72 extends between arms 22 and supports forks 56 and actuators 58, lock arms 60, lock arm actuators 62, support arms 64 and support arm actuators 66. Ears 74 are fixedly secured to shaft 72. Each ear 74 has a first end 76 pivotably coupled to end 46 of a support arm 22 and a second opposite end 78 pivotably coupled to actuator 58. Ear 74 provides a lever arm about which actuators 58 pivot central shaft 72 about axis 70. Although ears 74 and actuators 58 are illustrated extending forwardly from arms 22, ears 74 and actuators 58 may alternatively extend rearwardly on a back side of arms 22.

Forks 56 comprise elongate members extending forwardly from central shaft 72 and spaced apart from one another so as to be simultaneously positionable within the channels of a FEL container. In the exemplary embodiment, each fork 56 is fixedly coupled to central shaft 72 such that pivotal movement of central shaft 72 about axis 70 also pivots forks 56 about axis 70. Alternatively, forks 56 may be pivotably secured to central shaft 72 for independent rotation about 70 by additional actuators. Each fork 56 generally includes channel support and trunnion guide surface 82, hook 84 and trunnion capture surface 86. Surface 82 comprises a generally planar surface extending between hook 84 and trunnion capture surface 86. Surface 82 serves two alternative functions depending upon the type of container being engaged by adapter system 12. When adapter system 12 is engaging a FEL container, surface 82 provides a surface upon which an upper portion of the side channels rest as the FEL container is being lifted and inverted. At the same time, hooks 84 include surfaces extending non-parallel from surface 82 so as to engage end portions of the side channels to retain the channels upon surface 82. Although less desirable, hooks 84 may be omitted. When adapter system 12 is loading a REL container, surface 82 is configured to engage the lower-most surfaces of the trunnion end portions to guide the trunnion end portions into engagement with trunnion capture surfaces 86. Trunnion capture surfaces 86 of forks 56 form a C-shaped opening 88 facing forwardly toward surface 82. The openings 88 provided by surfaces 86 receive the opposite end portions of the trunnion to partially capture the end portions of the trunnion. Surfaces 86 cooperate with surfaces provided by lock arms 60 to fully capture the end portions of the trunnion.

Actuators 58 comprise conventionally known hydraulic piston-cylinder assemblies fluidly connected to the hydraulic system and the control system of the work vehicle (not shown). Each actuator 58 has a first end pivotably coupled to end 78 of ear 74 and a second end pivotably coupled to one of lift arms 22. Actuation of actuators 58 pivots ears 74, central shaft 72 and forks 56 about axis 70 to align and position forks 56 within the side channels of a FEL container or to alternatively position surface 82 below end portions of the trunnion as the end portions of the trunnion are guided into engagement with trunnion capture surfaces 86.

Lock arms 60 comprise elongate members pivotably supported adjacent to forks 56 and extending forwardly of central shaft 72. In the exemplary embodiment, lock arms 60 are pivotably coupled to forks 56 for rotation by actuator 62 about axis 90 (shown in FIG. 3). Alternatively, lock arms 60 may be pivotably coupled to central shaft 72 for rotation about axis 70 or may be pivotably coupled for rotation about various other alternative axes. Each lock arm 60 generally includes trunnion capture surface 92 and container stop surface 94. Trunnion capture surface 92 moves between a trunnion encircling position and a trunnion non-encircling position. In the trunnion encircling position, trunnion capture surface 92 cooperates with trunnion receiving surface 86 to surround and encircle the end portion of the trunnion. Although trunnion capture surface 92 and trunnion receiving surface 86 preferably completely encircle the end portion of the trunnion, trunnion capture surface 92 and trunnion receiving surface 86 may alternatively be configured to only partially encircle, surround or capture the end portion of the trunnion so long as non-rotational movement of the trunnion is substantially prevented. In the non-encircling position, trunnion capture surface 92 is withdrawn from trunnion capture surface 86 to permit either the insertion of the end portion of the trunnion into opening 88 or the withdrawal of the end portion of the trunnion from opening 88.

Container stop surfaces 94 extend from lock arms 60 so as to engage and abut upper edges of the container side walls. In the exemplary embodiment, each container stop surface 94 is provided by an inwardly extending shaft 96. Alternatively, container stop surfaces 94 may be formed by various other structures. Moreover, depending upon the particular location of lock arms 60, container stop surfaces 94 may be formed upon outwardly extending shafts or other structures. Although less desirable due to the increased number of parts as well as reduced compactness, container stop surfaces 94 may be provided by alternative structures independent of lock arms 60, wherein lock arms 60 merely provide trunnion capture surfaces 92. Likewise, trunnion capture surfaces 92 may alternatively be provided by alternative structures independent of lock arms 60, wherein each lock arm 60 merely provides container stop surface 94. Container stop surfaces 94 move between an extended position in which stop surfaces 94 engage the upper edges of the side walls of the container and a retracted position in which container stop surfaces 94 are retracted away from the upper edges of the container side walls. Because container stop surfaces 94 are preferably formed as part of lock arms 60 which also provide trunnion capture surfaces 92, actuators 62 also move container stop surfaces 94 between the extended position and the retracted position. In particular, pivotal movement of lock arm 60 by actuator 62 simultaneously moves trunnion capture surface 92 and container stop surface 94 into the trunnion encircling position and the extended position. Reverse actuation of actuators 62 simultaneously moves trunnion capture surface 92 and container stop surface 94 to the trunnion non-encircling position and the retracted position, respectively. In addition to having fewer parts, increasing the compactness of adapter system 12 and reducing the cost of adapter system 12, this arrangement insures that the end portion of the trunnion is encircled and that the upper edge of the container is engaged by adapter system 12 prior to lifting of the container by lift arms 22.

Actuators 62 are secured to lock arms 60 and pivot lock arms 60 so as to move trunnion capture surfaces 92 between the trunnion encircling position and the trunnion non-encircling position and so as to move container stop surfaces 94 between the extended position and the retracted position. Actuators 62 preferably comprise hydraulic cylinder-piston assemblies which are hydraulically coupled to the hydraulic system of vehicle 10 and which are controlled in a conventionally known manner by the actuation of various valves and other conventionally known control mechanisms associated with the hydraulic system of vehicle 10. Alternatively, actuators 62 may comprise other well-known pneumatic, electrical and mechanical actuators. Although less desirable, actuator 62 may alternatively comprise manually powered mechanisms which pivot lock arm 60. Each actuator 62 has a first end 98 pivotably connected to support arm 64 and a second end pivotably connected to one of lock arms 60 based from axis 90. As a result, extension and retraction of actuator 62 pivots lock arm 60 about axis 90. In lieu of being pivotably coupled to support arms 64, actuator 62 may alternatively have an end pivotably coupled to other structures, such as support 54.

Support arms 64 extend from cross support 54 and provide container contact surfaces 104 located so as to engage a rear wall of a REL container between the trunnions of the REL container when the trunnions of the REL container are encircled by surfaces 86 and 92. In the exemplary embodiment, support arms 64 are pivotably coupled to cross support 54 for rotation about axis 106 which is preferably contiguous with axis 90. As a result, support arms 64 are movable between a container-engaging position and a retracted position. In the container-engaging position, surfaces 104 are brought into abutting engagement with the rear wall of the container. In the retracted position, surfaces 104 are withdrawn from the rear wall of the container. Because support arms 64 are pivotably supported, support arms 64 and surfaces 104 may be selectively and appropriately pivoted and repositioned to accommodate different containers having variously configured rear walls. In addition, support arms 64 may be pivoted into a more compact arrangement when adapter system 12 is not being utilized.

Support arm actuators 66 selectively and controllably pivot contact surfaces 104 between the container-engaging positions and the retracted positions. Actuators 66 preferably comprise conventionally known hydraulic cylinder-piston assemblies coupled to the hydraulic supply system and control system of vehicle 10. Each actuator 66 has a first end 108 pivotably coupled to support arm 64 and a second end 110 pivotably coupled to cross support 54. Alternatively, end 110 may be pivotably coupled to alternative structures of adapter system 12 other than cross support 54. Furthermore, in lieu of comprising hydraulic cylinder-piston assemblies, actuators 66 may comprise other well-known mechanical, electrical or pneumatic linear actuators as well as various well-known rotary actuators for selectively rotating support arm 64 about axis 106. Although less desirable, support arm 64 may be manually pivoted into engagement with the rear wall of the container and locked in place.

Figure 4:
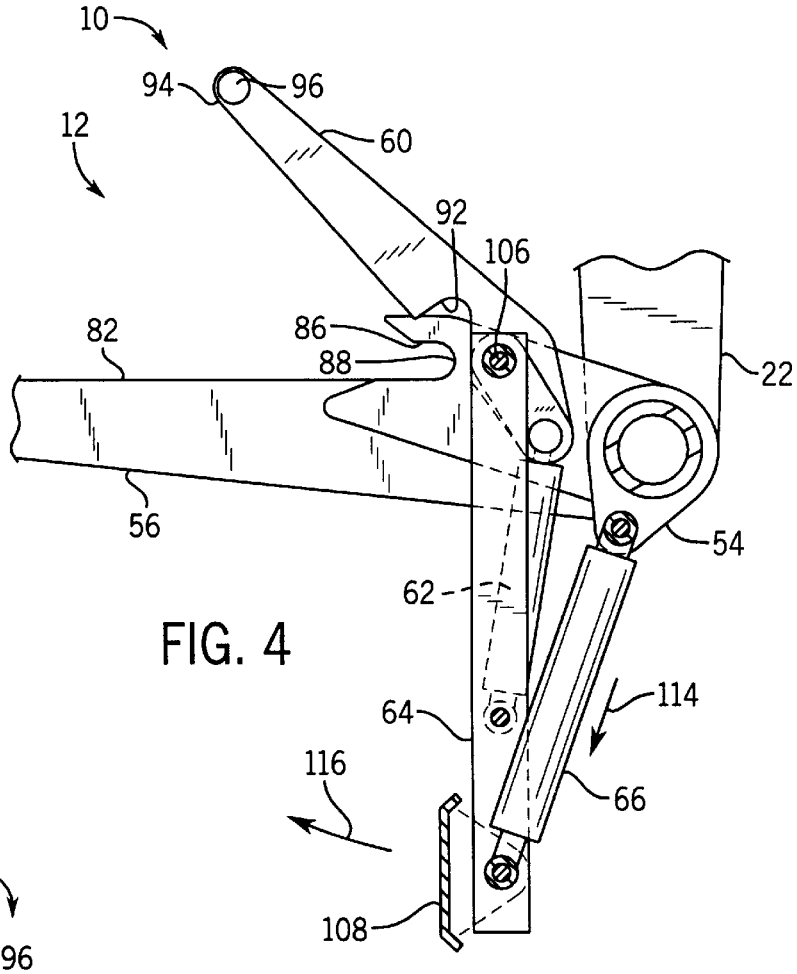
FIG. 4 is a sectional view of the adapter system of FIG. 3 taken along lines 4—4.
Figure 5:
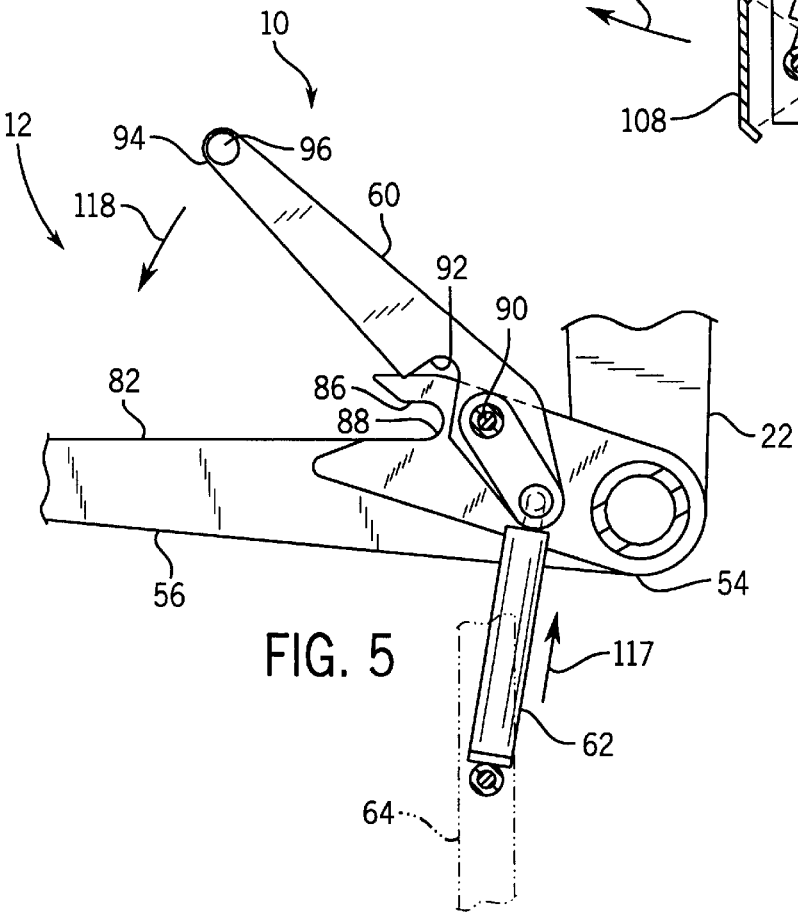
FIG. 5 is a sectional view of the adapter system of FIG. 3 taken along lines 5—5.

FIGS. 4 and 5 illustrate the selective movement of support arms 64 by actuators 66 as well as the movement of lock arms 60 by actuators 62. As best shown by FIG. 4, extension of actuator 66 in the direction indicated by arrow 114 pivots support arm 64 about axis 106 in the direction indicated by arrow 116 towards the container-engaging position. Likewise, retraction of actuators 66 pivots support arms 64 in the reverse direction about axis 106 to a retracted position.

As best shown by FIG. 5, extension of actuators 62 in the direction indicated by arrow 117 pivots lock arm 60 about axis 90 (contiguous with axis 106) in the direction indicated by arrow 118 whereby surface 92 is moved to the trunnion encircling position and whereby stop surface 94 is moved to the container engaging position. Likewise, retraction of actuators 62 pivots lock arm 60 in an opposite direction to move surface 92 to the non-encircling position and to move surface 94 to the disengaged position.

Figure 6:
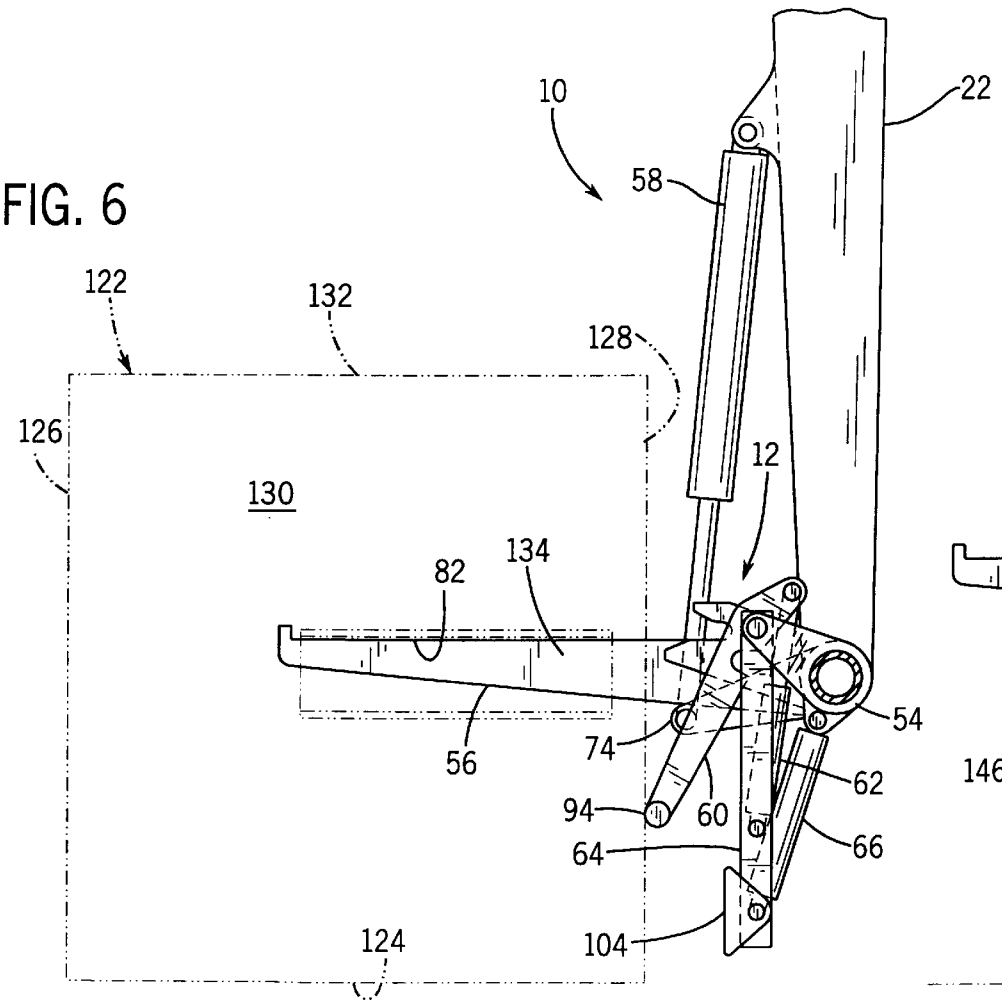
FIG. 6 is a sectional view of the adapter system of FIG. 3 in engagement with a FEL container.
Figure 7:
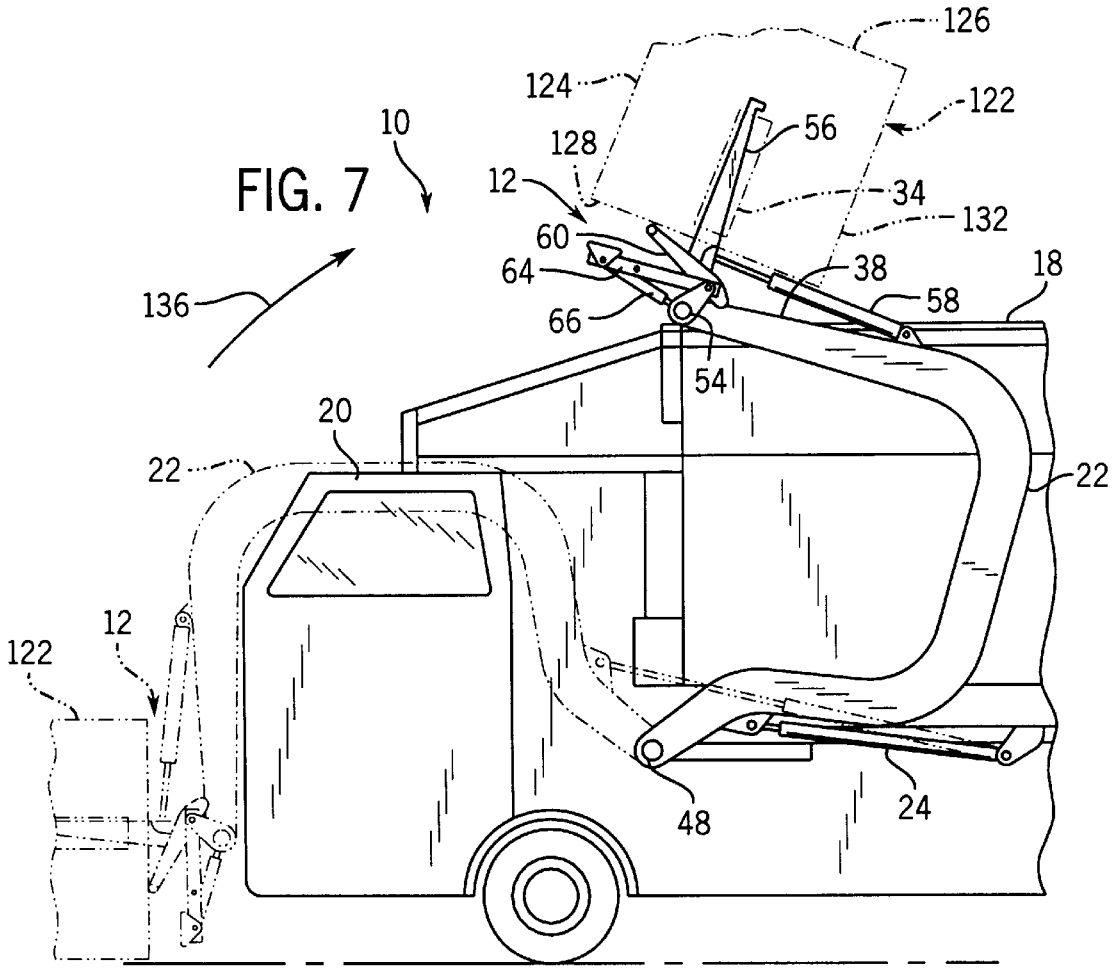
FIG. 7 is a fragmentary side elevational view of the work vehicle of FIG. 1 illustrating the adapter system engaging the FEL container as the work vehicle lifts and tilts the FEL container to unload the FEL container.
Figure 8:
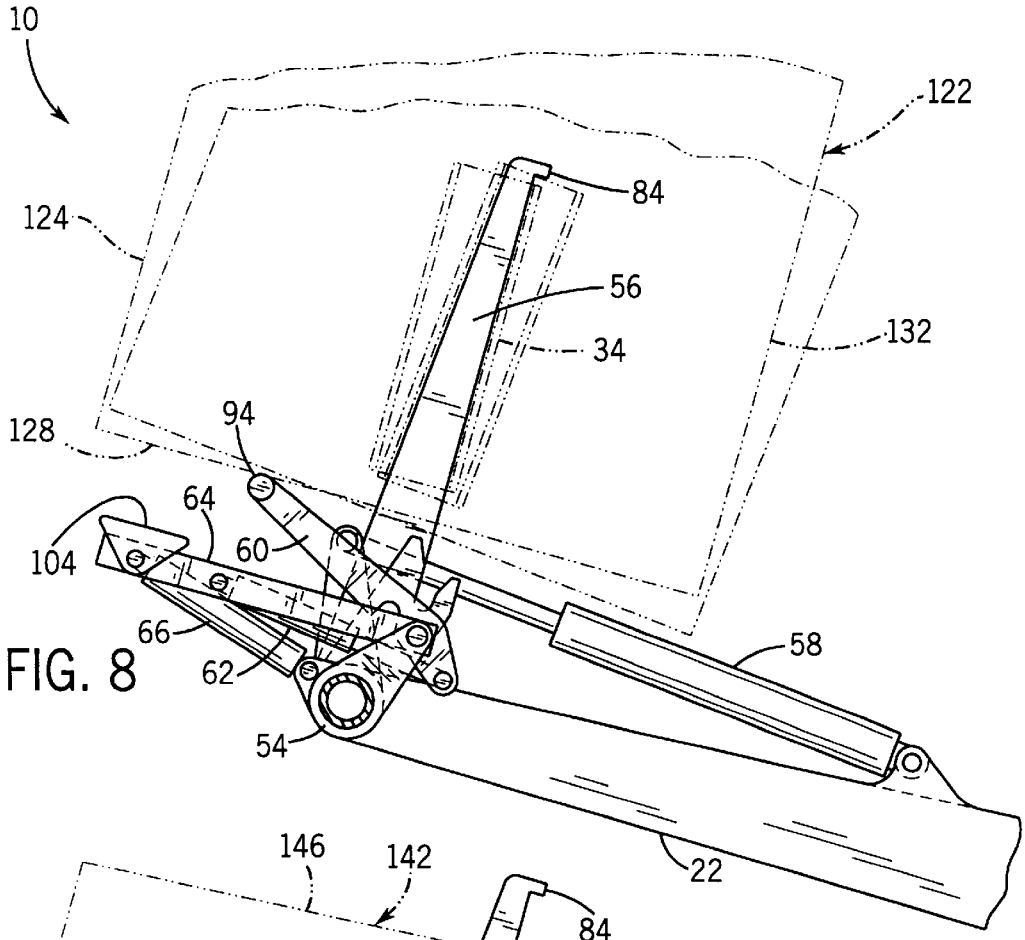
FIG. 8 is an enlarged fragmentary sectional view of the adapter system in the lifted and tilted position shown in FIG. 7.

FIGS. 6, 7 and 8 illustrate adapter system 12 engaging, lifting and unloading refuse from a front-loading (FEL) container 122 having a floor 124, a front wall 126, a rear wall 128, side walls 130 having upper edges 132, and side channels 134 on each of the side walls 130. Although not specifically illustrated, container 122 additionally includes an interior partition wall dividing the interior container 122 including two compartments corresponding to the two compartments within an interior 30 of storage body 18. As will be appreciated, container 122 may alternatively have more than one partitioning wall or zero partitioning walls depending upon the number of compartments within interior 30 of storage body 18 and depending upon whether refuse being collected must be segregated. As best shown by FIG. 6, container 122 is first engaged by adapter system 12 of work vehicle 10 by the operator selectively actuating actuator 58 and actuators 24 to pivot lift arms 22 about axis 48 (shown in FIG. 1) and to further pivot forks 56 about axis 70 so as to position forks 56 within and through channels 134. In the container-engaging position shown in FIG. 6, surface 82 engages channel 134 to support container 122 upon forks 56 while hooks 84 retain container 122 upon surface 82 of fork 56. In the exemplary embodiment, actuators 62 are further actuated by the operator to pivot lock arms 60 about axis 90 such that lock arms 60 and surfaces 94 engage rear wall 128 of container 122. Surfaces 94 prevent container 122 from sliding around upon forks 56. Alternatively, support arm 64 and surface 104 may be pivoted by actuators 66 into engagement with rear wall 128 to prevent container 122 from sliding around upon forks 56.

As best shown by FIGS. 7 and 8, once container 122 is completely engaged by adapter system 12, actuators 24 are further actuated to pivot lift arms 22 about axis 48 in the direction indicated by arrow 136 to lift and simultaneously tilt container 122 over cab 20 and into alignment with load opening 38 so that refuse within the interior of container 122 is unloaded, under the force of gravity, through load opening 38 into interior 30 (shown in FIG. 1) of storage body 18. Afterwards, actuators 24 are once again extended to pivot lift arms 22 in a reverse direction about axis 48 to once again lower container 122 for the loading of additional refuse or for being disconnected from adapter system 12 at an appropriate refuse collection site.

FIGS. 9–12 illustrate adapter system 12 engaging and lifting a rear end loading (REL) container 142 for unloading refuse from container 142. Container 142 is conventionally known and includes floor 144, front wall 146, rear wall 148, side walls 150 having upper edges 152, and trunnion 154 having opposite ends extending beyond each of side walls 150. Although not specifically illustrated, container 142 additionally includes an interior partition wall dividing the interior container 142 including two compartments corresponding to the two compartments within an interior 30 of storage body 18. As will be appreciated, container 142 may alternatively have more than one partitioning wall or zero partitioning walls depending upon the number of compartments within interior 30 of storage body 18 and depending upon whether refuse being collected must be segregated.

Figure 9:
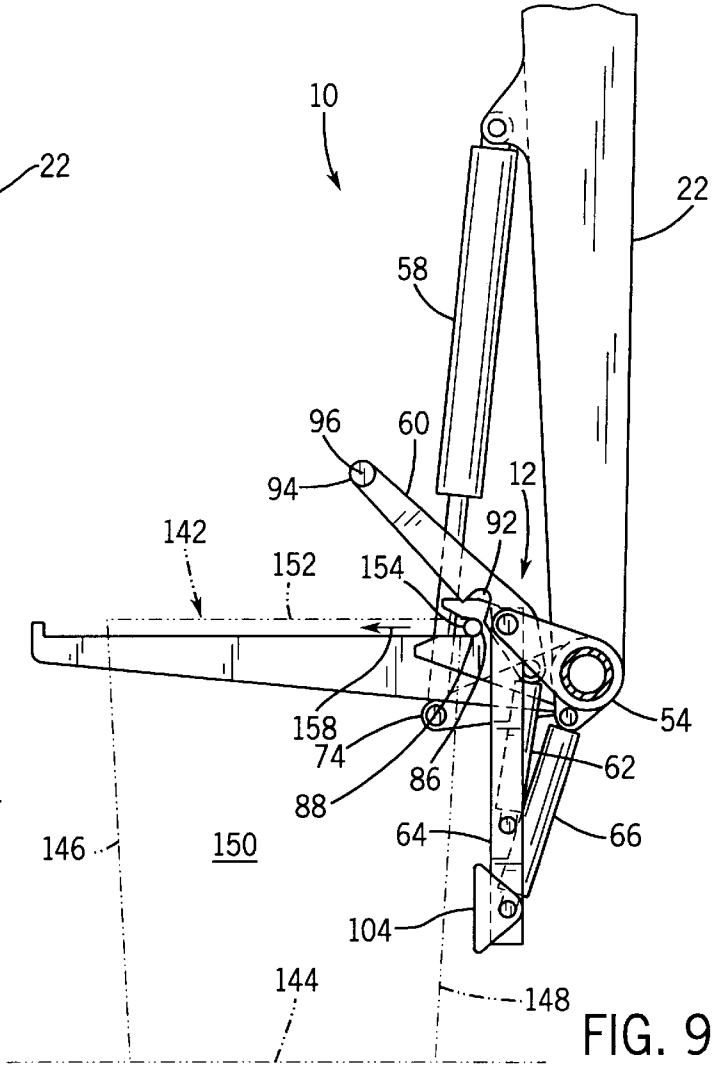
FIG. 9 is an enlarged sectional view of the adapter system of FIG. 3 engaging a REL container.

As best shown by FIG. 9, to engage container 142, actuators 24 (shown in FIG. 1) and 58 pivot lift arms 22 and cross support 54 so as to position surface 82 of forks 56 just below and into engagement with the ends of trunnions 154 adjacent each of sides 150. Vehicle 10 is driven forwardly and actuators 24 and 58 may further be actuated to additionally move forks 56 forwardly in the direction indicated by arrow 158 until opening 88 receives the ends of trunnion 154, whereby trunnion capture surfaces 86 partially encircle trunnion 154.

Figure 10:
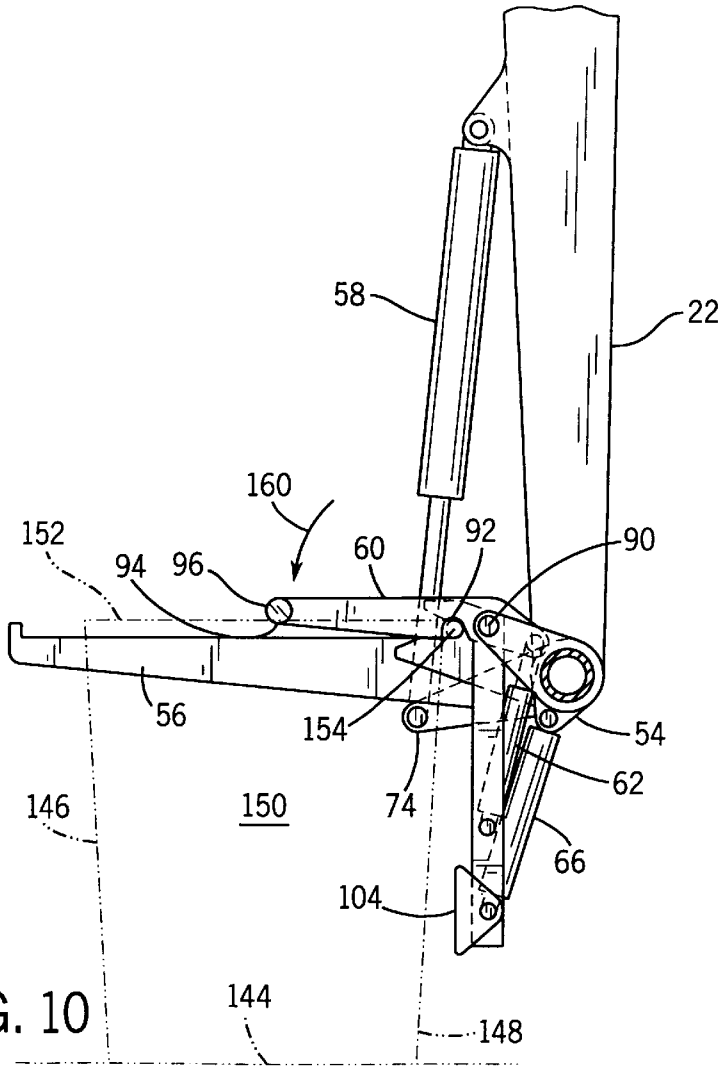
FIG. 10 is an enlarged sectional view of the adapter system of FIG. 3 illustrating the adapter system being actuated to a trunnion encircling position and a container-engaging position.

As best shown by FIG. 10, actuators 62 are next actuated to pivot lock arms 60 about axis 90 in the direction indicated by arrow 160 until trunnion encircling surface 92 further partially encircles trunnion 154 so as to collectively encircle trunnion 154 and until container stop surfaces 94 are brought into engagement with upper edges 152 of side walls 150.

Figure 11:
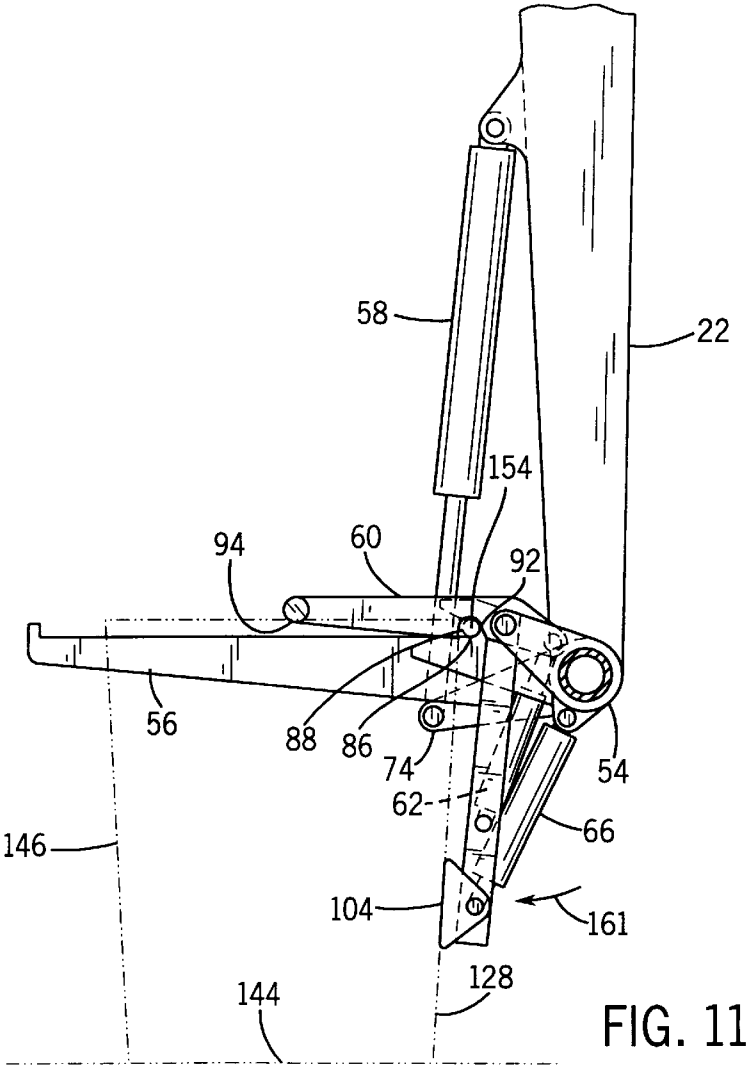
FIG. 11 is an enlarged sectional view of the adapter system of FIG. 10 illustrating the adapter system being further actuated to engage a rear wall of the REL container.

Referring to FIG. 11, actuators 66 are next actuated so as to pivot arms 64 about axis 106 in the direction indicated by arrow 161 until surfaces 104 are brought into abutting contact with rear wall 148 of container 142. As a result, container 142 is now fully engaged. The ends of trunnion 154 are each fully encircled by trunnion capture surfaces 86 and 92. Upper edges 152 of side walls 150 are engaged by container stop surfaces 94 to prevent pivoting about trunnion 154 in a clockwise direction as seen in FIG. 11. Rear wall 148 of container 142 is engaged by surfaces 104 to prevent pivoting of container 142 about trunnion 154 in a counterclockwise direction as seen in FIG. 11. Container 142 is ready for lifting and unloading.

Figure 12:
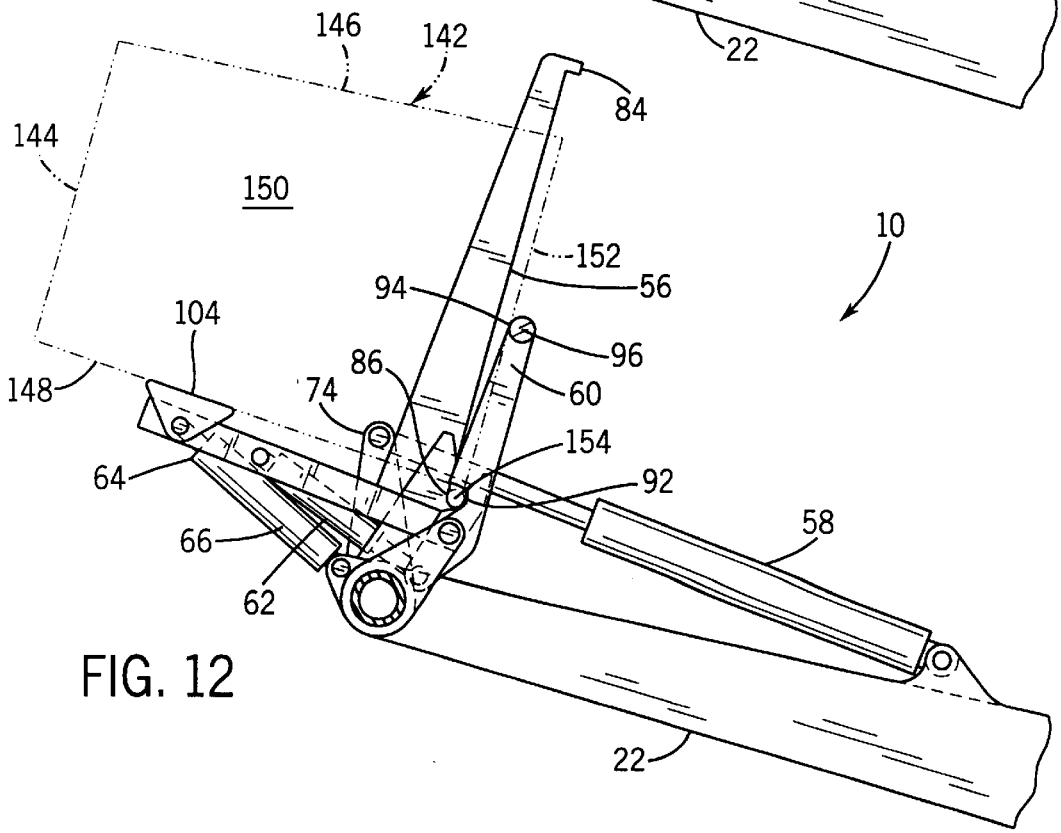
FIG. 12 is an enlarged sectional view of the adapter system of FIG. 11 illustrating the adapter system as the refuse collection vehicle which lifts and tilts the engaged REL container over and above the refuse collection vehicle.

Referring to FIG. 12, actuators 24 and actuators 58 are extended or retracted, as necessary, to lift and tilt container 142 over cab 20 (shown in FIG. 1) and into at least partial alignment with load opening 38 (shown in FIG. 1), whereby refuse within container 142 falls under the force of gravity through load opening 38 into interior 30 of storage body 18. Once refuse from container 142 has been unloaded through load opening 38 into storage body 18 of work vehicle 10, actuators 24 and 58, as necessary, are once again actuated to pivot and tilt container 142 in a reverse direction so as to bring container 142 back in front of work vehicle 10 upon the ground or other supporting surface. To disengage container 142, actuators 66 are actuated to move surfaces 104 to the disengaged position and to move lock arms 60 such that trunnion encircling surface 92 and container stop surface 94 are each moved to the disengaged position shown in FIG. 9. Actuator 24 of work vehicle 10 are then moved in the direction opposite to the direction indicated by arrow 158 in FIG. 9 to completely withdraw trunnion 154 from opening 88. As a result, adapter system 12 of work vehicle 10 is now ready to engage and unload a completely different REL container 142 or a FEL container 122. Such engagement and loading of containers is achieved without the operator having to leave cab 20. As a result, refuse collection is more cost and time efficient. Although less desirable, controls for actuators 24, 58, 62 and 66 may alternatively be located outside cab 20 at convenient locations about work vehicle 10.

Figure 13:
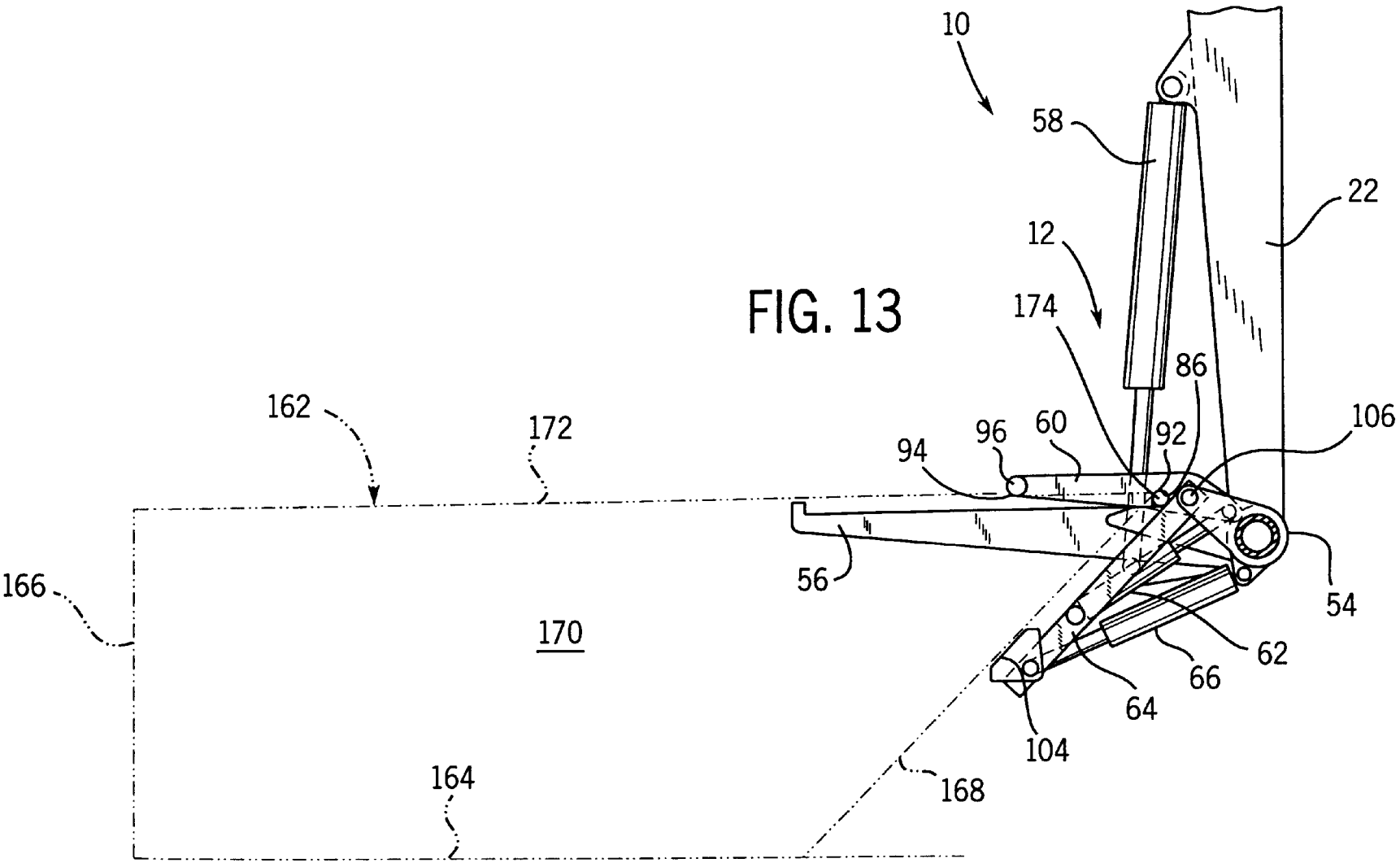
FIG. 13 is an enlarged sectional view of the adapter system of FIG. 3 engaging an alternative REL container.

In addition to being capable of engaging or unloading REL container 142 having rear wall 148, adapter system 12 is capable of loading alternative REL containers having variously sloped rear walls. FIG. 13 illustrates adapter system 12 engaging a much differently configured REL container 162, commonly referred to as a rear-loading dumpster. Container 162 generally includes floor 164, front wall 166, rear wall 168, side walls 170 having upper edges 172, and trunnion 174 having opposite ends projecting beyond each of side walls 170. As compared to rear wall 148 of container 142, rear wall 168 of container 162 slopes towards front wall 166 at a much larger angle. However, adapter system 12 accommodates this difference. In particular, to engage container 162, the operator simply actuates actuators 66 to pivot support arms 64 about axis 106 to a larger extent until surfaces 104 are once again brought into abutting engagement with rear wall 168 of container 162. The remaining steps required to engage and unload container 162 are substantial identical to those steps required to engage and unload container 142. Thus, adapter system 12 not only enables work vehicle 10 to accommodate both FEL and REL containers, but also enables work vehicle 10 to accommodate variously configured REL containers.

Figure 14:
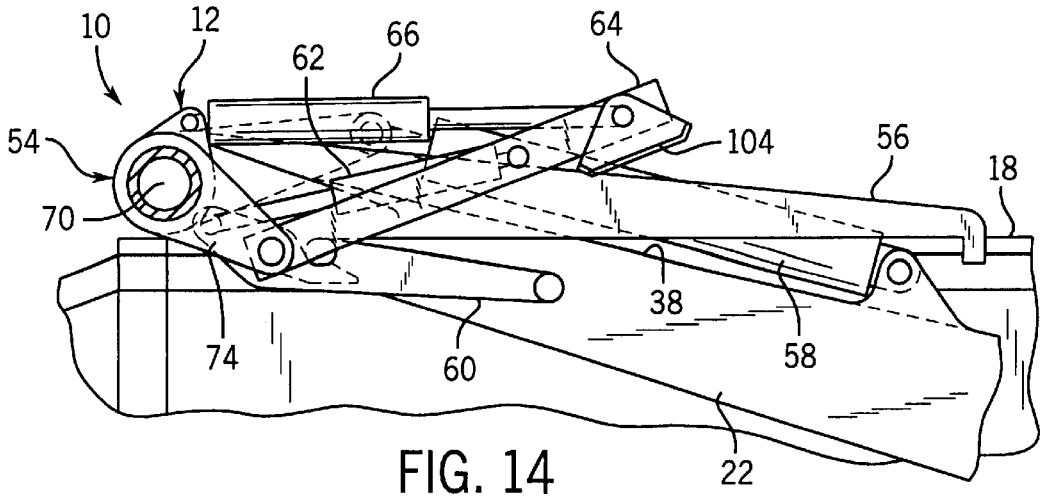
FIG. 14 is an enlarged fragmentary sectional view of the adapter system of FIG. 3 actuated into a compact transport and storage position over and above the refuse collection vehicle.

As best shown by FIG. 14, when adapter system 12 is not in use, adapter system 12 is configured to be compactly positioned out of the way. In particular, selective actuation of actuators 24 pivots lift arms 22 to the general position shown in FIG. 7 whereby adapter system 12 is generally positioned rearwardly of cab 20 above load opening 38. As a result, adapter system 12 does not project forwardly in front of cab 20. In addition, actuators 58 are actuated to pivot cross support 54 about axis 70 to thereby pivot forks 56 towards lift arms 22 to an overlapping, near parallel relationship with lift arms 22 as shown in FIG. 14. Likewise, actuators 62 and 66 are further selectively actuated to pivot lock arms 60 and support arms 64 to a side-by-side, substantially parallel relationship with forks 56. As a result, forks 56, lock arms 60 and support arms 64 do not substantially project above storage body 18 or work vehicle 10. Because adapter system 12 may be compactly stored above storage body 18 behind cab 20, adapter system 12 does not increase the overall effective length of work vehicle 10 when being driven or when being parked and does not substantially increase the vertical height of work vehicle 10 when traveling beneath low bridges and the like.

FIGS. 15–19 illustrate work vehicle 10 including adapter system 212, a first alternative embodiment of adapter system 12. Adapter system 212 is similar to adapter system 12 except that adapter system 212 includes forks 256 in lieu of forks 56 and includes lock arms 260 in lieu of lock arms 60. Adapter system 12 additionally includes container stop mechanism 300. For ease of illustration, only one side of adapter system 212 is shown in FIGS. 15–19. For ease of illustration, those components of adapter system 212 which correspond to identical components of adapter system 12 are numbered similarly. However, similar to adapter system 12, adapter system 212 includes two generally identical and symmetrical sides such that adapter system 12 has two forks 256, two lock arms 260, and two container stop mechanisms 300, as well as two support arms 64 and two of each of actuators 58, 62 and 66.

Figure 15:
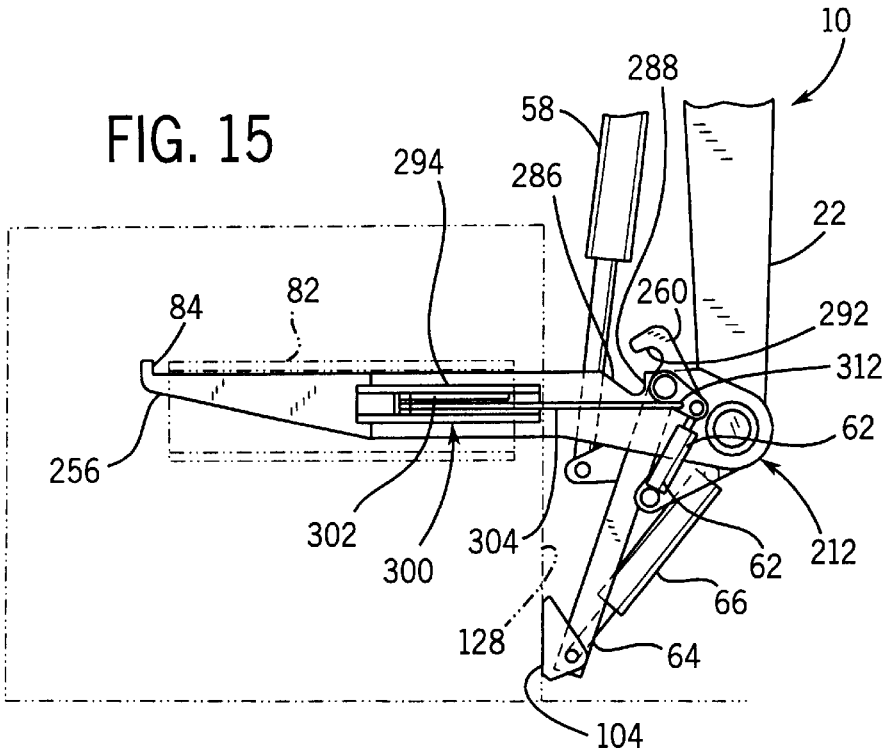
FIG. 15 is an enlarged side elevational view of a first alternative embodiment of the adapter system of FIG. 3 engaging a FEL container.

As best shown by FIG. 15, each fork 256 is substantially identical to fork 56 except that each fork 256 includes trunnion encircling surface 286 defining an opening 288 and additionally carries container stop mechanism 300. Trunnion encircling surface 286 defines opening 288 which is configured to at least partially receive an end of a REL container trunnion. Opening 288 faces in a general upward direction. Alternatively, opening 288 may face in a generally forward direction towards hook 84 of fork 256 to fully encircle the REL container trunnion and unloading an REL container.

Lock arm 260 is similar to lock arm 60 except that lock arm 260 omits container stop surface 94 and merely provides trunnion capture surface 292. Similar to lock arm 60, lock arm 260 is actuated by actuator 62 which pivots lock arm 260 and trunnion capture surface 292 between a trunnion non-encircling position (shown in FIG. 15) and a trunnion encircling position (shown in FIG. 18).

Figure 17:
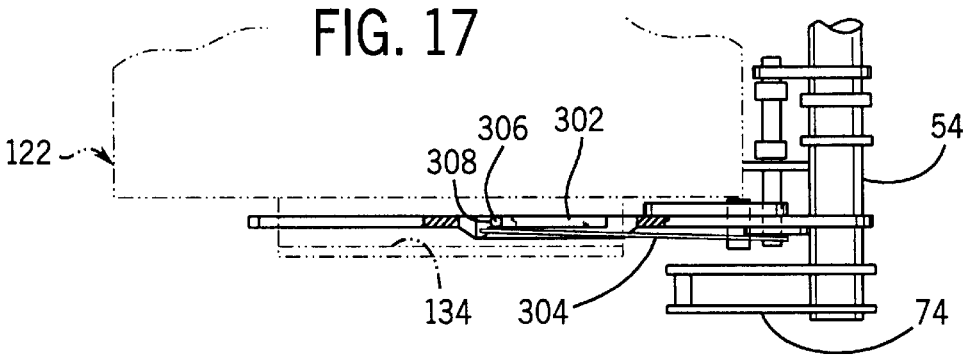
FIG. 17 is a top elevational view of the adapter system of FIG. 15 while engaging the FEL container.
Figure 19:
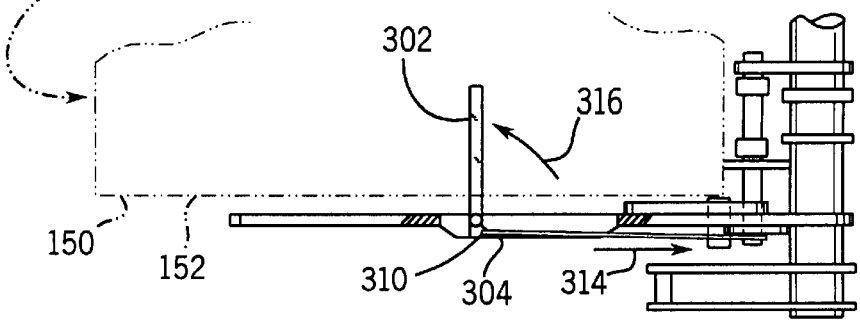
FIG. 19 is a top elevational view of the adapter system of FIG. 18 engaging the REL container as the adapter system is actuated to a container-engaging position.

Container stop mechanism 300 is generally carried by fork 256 and includes a container stop surface 294 which moves between an extended position (shown in FIG. 19) in which surface 294 engages upper edge 152 of side wall 150 of REL container 142 and a retracted position (shown in FIG. 17). As best shown by FIGS. 17 and 19, mechanism 300 generally includes container stop 302 and link 304. Container stop 302 comprises an elongate protuberance which has a lower edge providing container stop surface 294. Container stop 302 is pivotably coupled to fork 256 by pin 306 for rotation about axis 308. As a result, container stop 302 pivots about axis 308 between the extended position shown in FIG. 19 and the retracted position shown in FIG. 17. In the retracted position shown in FIG. 17, container stop 302 extends substantially parallel with fork 256. In the exemplary embodiment, container stop 302 extends generally contiguous with fork 256 such that container stop 302 does not project beyond sides of fork 256. As a result, when container stop 302 is in the retracted position shown in FIG. 17, fork 256 may be easily positioned within channel 134 of FEL container 122. In the extended position shown in FIG. 19, container stop 302 extends non-parallel, and preferably perpendicular, to fork 256 so as to position container stop surface 294 above and in engagement with upper edge 152 of side wall 150 of REL container 142. Container stop 302 is pivoted about axis 308 between the extended position and the retracted position by actuator 62 via link 304.

Link 304 comprises an elongate inflexible member, such as a rod, operably coupled between actuator 62 and container stop 302. Link 304 has a first end 310 preferably coupled to container stop 302 and a second end 312 pivotably coupled to lock arm 260. As a result, actuation of actuator 62 simultaneously moves trunnion encircling surface 292 between the trunnion encircling position and the trunnion non-encircling position and also simultaneously moves container stop 302 and container stop surface 294 between the engaged and retracted positions, respectively. Although less desirable, adapter system 212 may alternatively utilize a separate and distinct actuator operably coupled to container stop 302 to pivot container stop 302 between the extended position and the retracted position. For example, adapter system 212 may alternatively include an independent actuator carried by fork 256 and directly coupled to container stop 302. Moreover, although less desirable, container stop 302 may alternatively be configured to be manually or mechanically pivoted between the retracted position and the extended position shown in FIGS. 17 and 19, respectively.

FIGS. 15 and 17 illustrate adapter system 212 engaging FEL container 122. To engage FEL container 122, actuator 62 is selectively actuated to pivot container stop 302 to a retracted position such that forks 256 may be inserted into and through channel 134 as shown. Actuator 66 is then actuated to pivot support arm 64 to bring surface 104 into engagement with rear wall 128. Actuators 24 (shown in FIG. 1) and actuators 58 are then actuated to lift and pivot FEL container 122 over cab 20 and above storage body 18 into at least partial alignment with load opening 38 whereby refuse, under the force of gravity, falls into storage body 18 (shown in FIG. 1).

Figure 16:
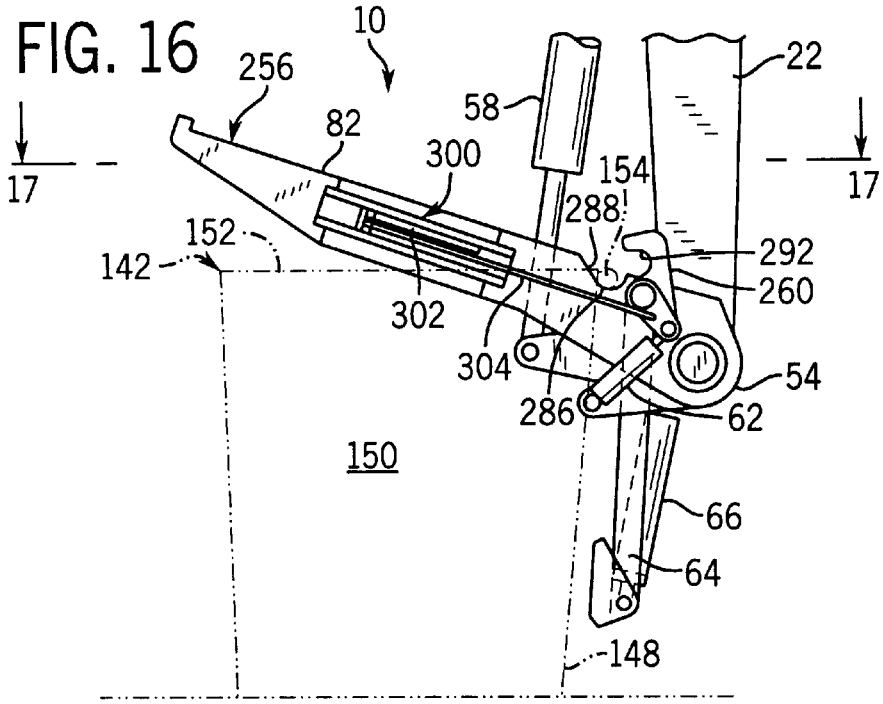
FIG. 16 is an enlarged side elevational view of the adapter system of FIG. 15 engaging a REL container.
Figure 18:
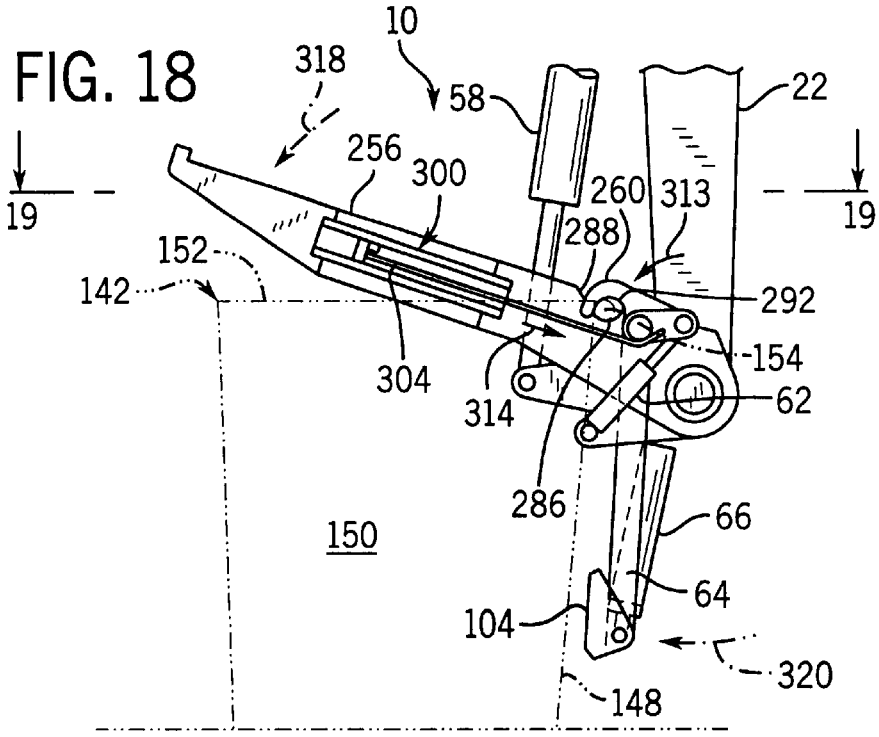
FIG. 18 is a side elevational view of the adapter system of FIG. 16 illustrating actuation of the adapter system into a trunnion encircling position.

FIGS. 16, 18 and 19 illustrate adapter system 212 engaging REL container 142. As best shown by FIG. 16, work vehicle 10 is moved forwardly and actuators 24 and 58 are actuated so as to position surface 82 below and in contact with trunnion 154. Surface 82 guides trunnion 154 into opening 288 whereby trunnion capture surfaces 286 partially encircle trunnion 154. To facilitate the positioning of trunnion 154 within opening 288, fork 256 may be tilted by actuators 58 as shown in FIG. 16.

As best shown by FIG. 18, once trunnion 154 has been positioned within opening 288, actuators 62 are actuated to pivot lock arms 260 in the direction indicated by arrow 313 such that trunnion capture surface 292 cooperates with trunnion capture surface 286 to substantially encircle trunnion 154. At the same time, the pivotal movement of lock arm 260 pulls link 304 in the direction indicated by arrow 314 which pivots container stop 302 in the direction indicated by arrow 316 (shown in FIG. 19) from the retracted position to the extended position. Actuators 58 are then actuated to pivot forks 256 in the direction indicated by arrow 318 to lower container stop surface 294 of container stops 302 into abutting engagement with edges 152 of side walls 150. Actuators 66 are further actuated to pivot support arms 64 in the direction indicated by arrow 320 such that surfaces 104 is brought into abutting engagement with rear wall 148 of REL container 142. Having now fully engaged rear wall 148, upper edges 152 and trunnion 154 of REL container 142, adapter system 212 is lifted and pivoted by actuation of actuators 24 to lift and tilt container 142 over cab 20 and above storage body 18 into substantial alignment with load opening 38 (shown in FIG. 1) whereby refuse, under the force of gravity, falls into storage body 18. Reverse operation lowers and disengages container 142 from adapter system 212. Thus, adapter system 212 is configured to engage and unload refuse from both FEL containers and REL containers. Adapter system 212 is also configured to engage variously designed REL containers such as REL container 162 shown in FIG. 13. Although not specifically shown, adapter system 212 is also configured to be compactly folded and stored in a similar fashion to system 12 shown in FIG. 14.

FIGS. 20–24 illustrate refuse collection vehicle 10 including adapter system 412, a second alternative embodiment of adapter system 12. Adapter system 412 generally includes cross member 454, actuators 458, forks 456, actuators 462, support arms 464, and container stop 467 (shown in FIGS. 23–25). Cross member 454 is similar to cross support 54 of system 12 except that cross member 454 slidably supports forks 456 along axis 70. Cross member 454 generally includes central shaft 472 and a pair of opposing forwardly extending ears 474. Central shaft 472 extends between lift arms 22 (shown in FIGS. 22 and 23) of work vehicle 10 and provides a surface along which forks 456 slide along axis 70. In the exemplary embodiment, central shaft 472 is adapted to be removably coupled to lift arms 22 such that adapter system 412 may be added on to existing refuse collection vehicles and may be easily removed for repair and maintenance.

Ears 474 are fixedly secured to shaft 472. Each ear 474 has a first end pivotably coupled to end 46 of support arm 22 and a second end pivotably coupled to actuator 458. Each ear 474 provides a lever arm about which actuators 58 pivot central shaft 72 about axis 70.

Forks 456 comprise elongate members extending forwardly from central shaft 72 and spaced apart from one another so as to be simultaneously positionable within channels of a FEL container. Each fork 456 is preferably fixedly coupled to central shaft 72 such that pivotal movement of central shaft 72 about axis 70 also pivots forks 456 about axis 70. In addition, each fork 456 is slidably coupled to central shaft 472 for movement along axis 70. Each fork generally includes channel support surface 482, hook 484, and trunnion encircling openings 486, 488. Surface 482 comprises a generally planar surface extending from hook 484 to cross member 454. Surface 482 provides a surface upon which an upper portion of channel 134 (shown in FIG. 22) rests as FEL container 122 is being lifted and inverted. Hooks 484 includes surfaces extending non-parallel from surfaces 482 so as to engage end portions of side channels 134 to retain channels 134 upon surfaces 482.

Trunnion-receiving openings 486, 488 extend through both forks 456 in general alignment with one another. Openings 486 are generally positioned forward of openings 488 and are configured and located to receive opposing end portions of trunnion 154 of REL container 142 upon movement of forks 456. Openings 488 are configured and located so as to receive the opposite end portions of trunnion 174 of REL container 162. In the exemplary embodiment, each of openings 486 and 488 comprise generally circular openings. As will be appreciated, openings 486 and 488 may have various other alternative shapes so long as openings 486 and 488 at least substantially surround end portions of either trunnions 154 or 174 to prevent non-axial movement of trunnions 154 or 174 out of openings 486 or 488.

Actuators 462 are coupled between cross member 454 and each of forks 456. Actuators 462 selectively reciprocate forks 456 along axis 70 so as to move trunnion encircling openings 486, 488 between non-encircling positions (shown in FIG. 20) in which forks 456 as well as openings 486, 488 are positioned axially beyond end portions of trunnion 154 or trunnion 174, and a trunnion encircling position (shown in FIGS. 21, 23 and 24) in which either openings 486 or 488 have been moved axially inward so as to receive end portions of trunnion 154 or trunnion 174, respectively. In the exemplary embodiment, actuators 462 preferably comprise conventionally known hydraulic cylinder-piston assembly fluidly connected to the hydraulic supply system of work vehicle 10 and configured to be controlled by the control system of work vehicle 10 in a conventionally known manner to move forks 456 along axis 70. Although actuators 462 preferably comprise hydraulic cylinder-piston assemblies, actuators 464 may alternatively comprise other linear actuators such as pneumatic, electrical or mechanical linear actuators configured to linearly move two elements relative to one another. Although less desirable, actuators 462 may be replaced with manually powered linear actuating mechanisms to move forks 456 along axis 70.

Figure 22:
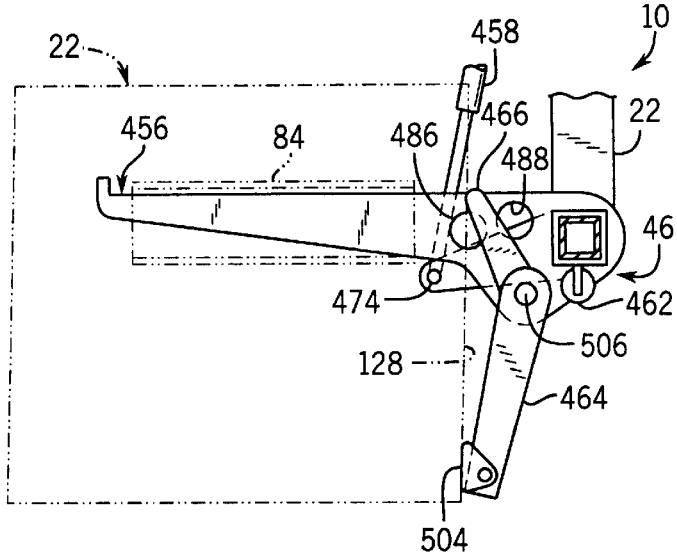
FIG. 22 is a fragmentary sectional view of the refuse collection vehicle illustrating the adapter system engaging a FEL container.
Figure 23:
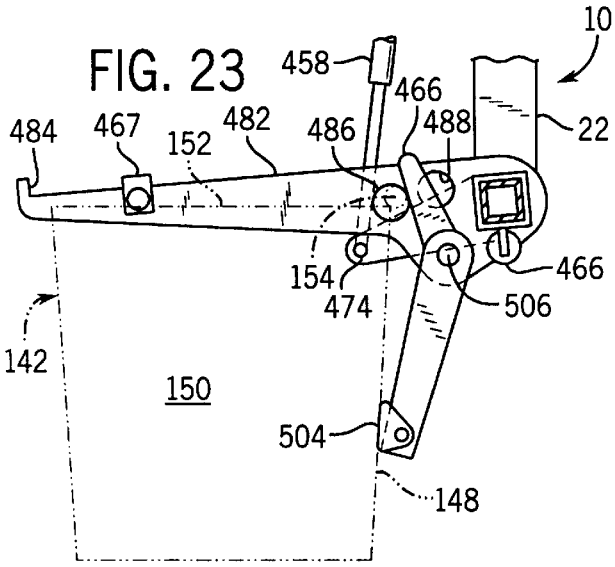
FIG. 23 is an enlarged fragmentary sectional view of the refuse collection vehicle illustrating the adapter system engaging a first REL container.
Figure 24:
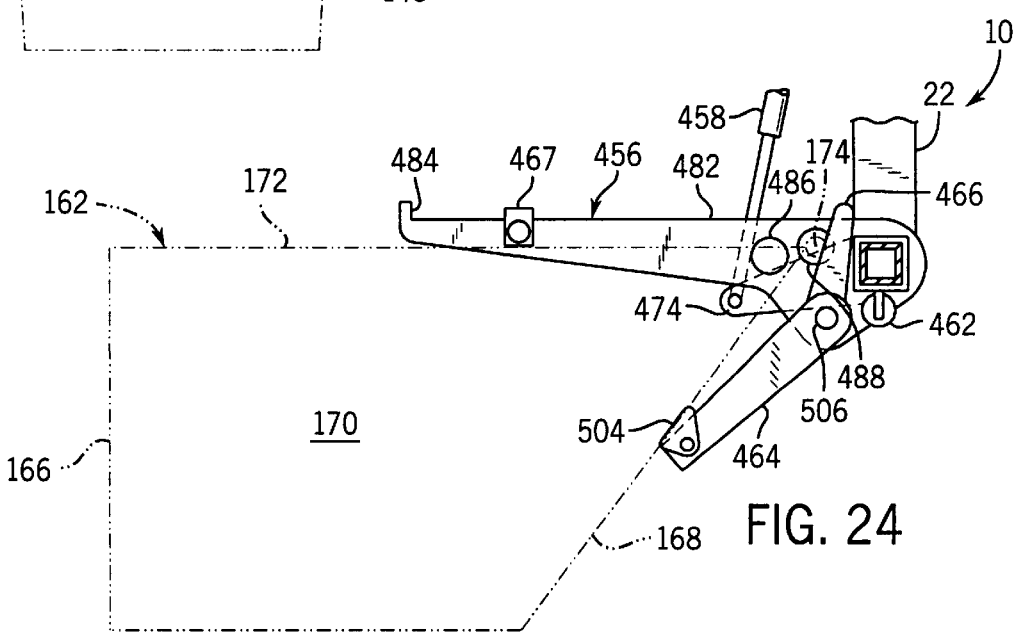
FIG. 24 is an enlarged sectional view of the refuse collection vehicle illustrating the adapter system engaging a second REL container.

Support arms 464 are adapted to engage either rear wall 128 of FEL container 122 (shown in FIG. 22), rear wall 148 of REL container 142 (shown in FIG. 23) or rear wall 168 of REL container 162 (shown in FIG. 24) to limit pivotal movement of containers 122, 142 and 162 in a counterclockwise direction as seen in FIGS. 22–24 as containers 122, 142 and 162 are being lifted and inverted over load opening 38 of storage body 18 (shown in FIG. 7). Support arms 64 provide container contact surfaces 504 located so as to engage container rear walls. In the exemplary embodiment, support arms 464 are pivotably coupled to forks 456 for rotation about axis 506 between a container-engaging position and a retracted position. In the container-engaging position, surfaces 504 are brought into abutting engagement with the rear wall of the container. In the retracted position, surfaces 504 are withdrawn from the rear wall of the container. Because support arms 464 are pivotably supported, support arms 464 and surfaces 504 are repositioned to accommodate different containers having variously configured rear walls. In the exemplary embodiment, support arms 464 are pivoted between the container-engaging position and the retracted position by lever arm 466.

Lever 466 is an elongate member disposed to the inside of and between forks 456 and non-rotatably coupled to support arm 464. Lever 466 is configured to pivot support 464 from the retracted position to the container-engaging position upon lever arm 466 itself engaging the container. Lever arms 466 eliminate the need for powered actuators to pivot support arms 464. In lieu of pivotally supporting lift arms 464 to forks 456 and in lieu of utilizing a mechanical lever arm to pivot support arms 464 between the retracted position and the container-engaging position, adapter system 412 may alternatively utilize independent powered linear actuators to pivot lift arms 464. Moreover, although lift arms 464 are illustrated as being pivotably supported by forks 456, lift arms 464 may alternatively be pivotably coupled directly to central shaft 472, wherein support arms 464 are pivoted by lever arms 464 or by an independent powered actuator.

Container stops 467 extend from forks 456 and are adapted to engage either edges 152 of sides walls 150 of REL container 142 or edges 172 of side walls 170 of REL container 162. Container stops 467 are configured to be releasably mounted to forks 456. As a result, container stops 467 may be mounted to forks 456 when adapter system 412 is to be used for lifting and unloading REL containers or may be removed from forks 456 when adapter system 412 is to be used for lifting and unloading FEL containers.

Figure 25:
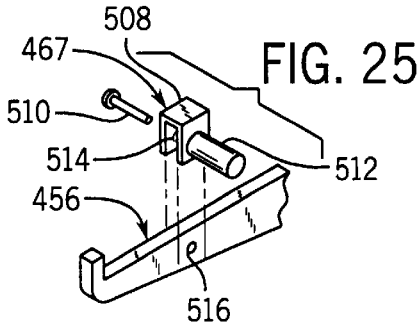
FIG. 25 is a fragmentary exploded perspective view of the adapter system of FIG. 23.

An exemplary embodiment of a container stop 467 is best illustrated in FIG. 25. As shown by FIG. 25, container stop 467 includes mounting portion 508, pin 510 and projection 512. Mounting portion 508 is generally a U-shaped rigid member having a pair of openings 514 therethrough configured to receive pin 510. Mounting portion 508 enables stop 467 to be mounted to forks 456 by receiving forks 456. Pin 510 extends through openings 514 and further extends through opening 516 in forks 456 to further secure mounting portion 508 to forks 456.

Projection 512 preferably comprises a rod or bar permanently affixed to mounting portion 508 and projecting from mounting portion 508 a sufficient distance so as to provide a surface for engaging an edge of an REL container. As will be appreciated, projection 512 may have various other configurations and shapes so long as the container stop surface is provided. Moreover, although container stop 467 is illustrated as being removably pinned to forks 456, container stop 467 may be mounted to fork 456 by various other well-known fastening methods and means so long as container stop 467 is readily removable for enabling adapter system 412 to lift and unload both REL containers and FEL containers. Alternatively, if adapter system 412 is intended for use only with REL containers, container stop 467 may be permanently mounted to fork 456.

Similar to adapter systems 12 and 212, adapter system 412 is configured to lift and unload both REL containers and FEL containers. FIG. 22 best illustrates adapter system 412 engaging FEL container 122 prior to lifting and unloading of container 122. To engage FEL container 122, the operator, via a conventionally known controls and a conventionally known hydraulic system, actuates actuators 462 to move forks 456 into alignment with openings of channels 234. Container stops 467 are removed from forks 456. The operator then drives work vehicle 10 towards container 122 in a forward direction until forks 456 extend through channels 134 of container 122. As work vehicle 10 moves forwardly, rear wall 128 of container 122 engages lever arm 466 above axis 506 which in turn pivots support arm 464 and contact surface 504 into engagement with rear wall 128 below axis 506. As a result, container 122 is now fully engaged and ready for being lifted and inverted over load opening 38 of storage body 18.

Figure 20:
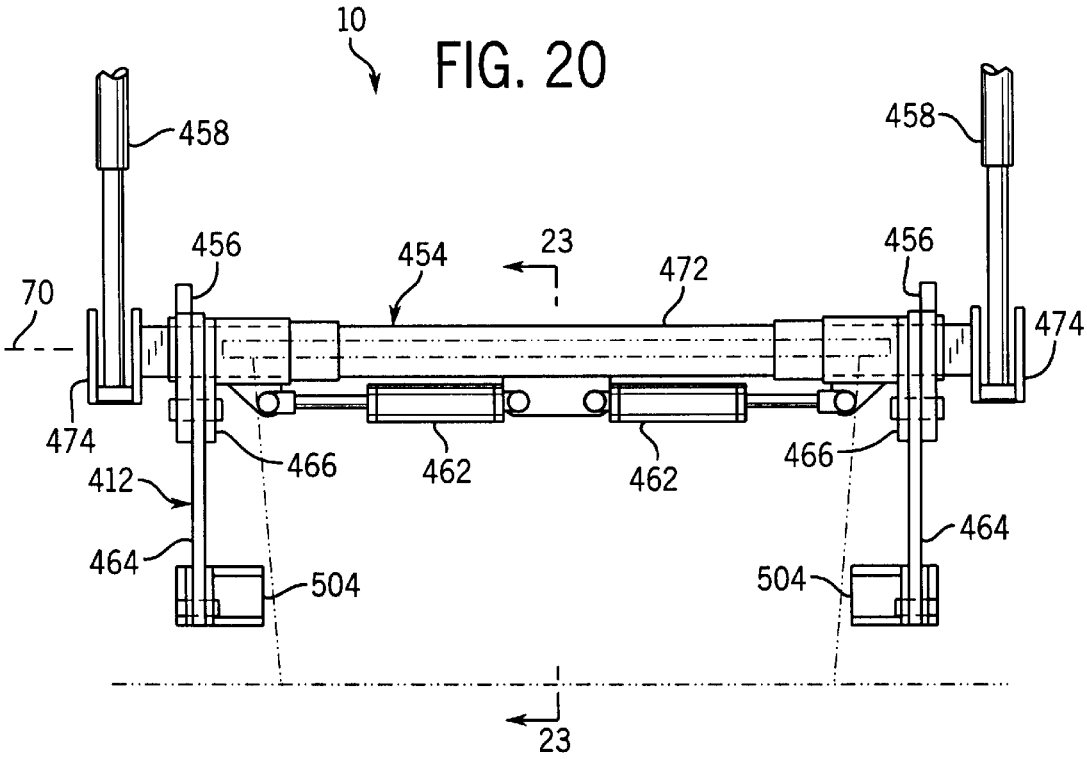
FIG. 20 is a fragmentary rear elevational view of the refuse collection vehicle including a second alternative embodiment of the adapter system of FIG. 3.
Figure 21:
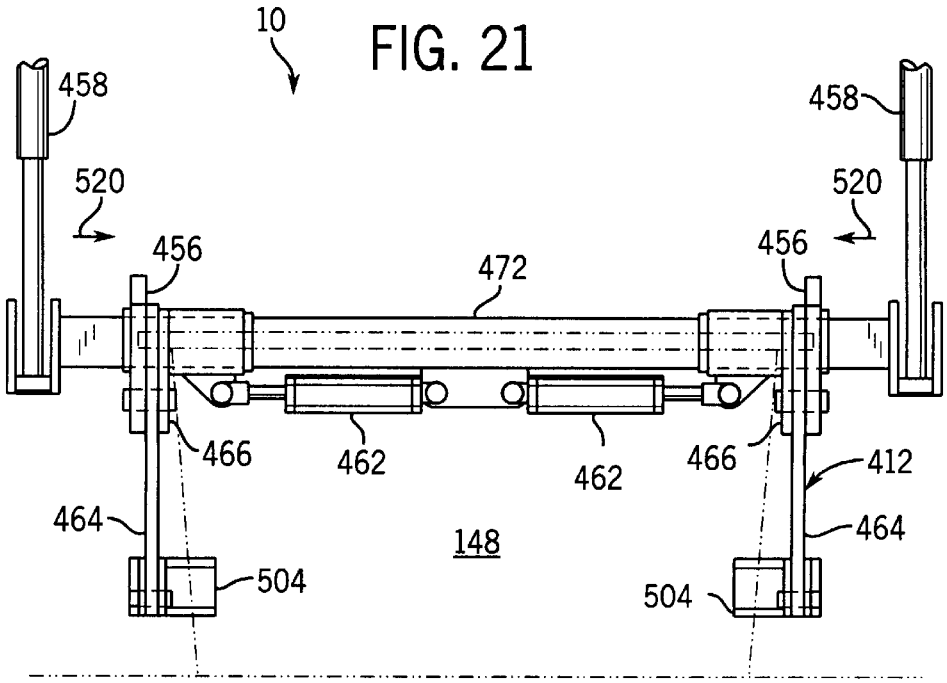
FIG. 21 is a fragmentary rear elevational view of the adapter system of FIG. 20 after the adapter system has been actuated to a trunnion encircling position.

FIGS. 20, 21 and 23 best illustrate adapter system 412 engaging REL container 142 prior to lifting and inverting REL container 142. As shown by FIG. 20, actuators 462 are first actuated to move forks 456 outwardly, away from one another to position such that forks 456 may completely straddle REL container 142 and the opposite end portions of trunnion 154. As shown by FIG. 23, work vehicle 10 is then driven forwardly towards container 142 and actuators 458 are actuated to pivot forks 456 so as to align end portions of trunnion 154 with openings 486. During this alignment, a central portion of trunnion 154 between the opposite end portions of rear wall 148 engages lever arm 466 to pivot support arms 464 such that contact surfaces 504 are brought into contact with rear wall 148. As shown by FIG. 21, actuators 462 are then actuated to move forks 456 inwardly in the direction indicated by arrows 520 until the opposite end portions of trunnion 154 extends at least partially through openings 486. As shown by FIG. 23, container stops 467 are mounted to each of forks 456 such that projections 512 engage edges 152. REL container 142 is now ready for being lifted and inverted over load opening 38 of storage body 18 (shown in FIG. 7).

FIG. 24 illustrates adapter system 412 engaging and alternatively configured REL container 162. The process for engaging container 162 is substantially identical to the process for engaging container 142 except that work vehicle 10 must be driven forwardly and actuators 458 must be actuated to align opening 488 with trunnion 174 of container 162. As shown by FIG. 24, because opening 488 is positioned rearwardly of opening 486, trunnion 174 engages lever arm 466 to pivot support arm 464 to a greater extent so as to position contact surface 504 in engagement with rear wall 168.

Although adapter system 412 is illustrated as including two pair or spaced trunnion encircling openings 486, 488, adapter system 412 may alternatively include only a single pair of openings or greater than two pair of variously positioned openings for accommodating a multitude of different REL containers. Although adapter system 412 is illustrated as including forks 456 which are selectively reciprocated along axis 70 by actuators 462 to move openings 486 or 488 between the trunnion encircling position and the trunnion non-encircling position, and to also move container stop 467 inwardly so as to be extendable over and in engagement with upper edge 152 of REL container 142, adapter system 412 may alternatively be configured such that the plates or other members forming openings 486 and 488 are pivotably coupled to the forks to rotate about an axis substantially parallel with the forks between the trunnion encircling position and the trunnion non-encircling position. In such an alternative configuration, the same plate or member forming openings 486 and 488 may additionally include inwardly extending projection configured to engage edge 152 of container 142 when the member end openings 486, 488 are pivoted to the trunnion encircling positions. The pivotal movement of the plate or other member may be provided by conventionally known hydraulic, pneumatic or electrical linear actuators or rotary actuators. Alternatively, such pivotal movement may be performed manually, wherein means for locking the plate and openings 486, 488 in the two positions is provided. Such an alternative configuration is depicted in FIGS. 5 and 6 of co-pending application Ser. No. 09/001,283 filed on Dec. 31, 1997 entitled ADAPTER AND METHODS FOR EMPTYING REAR END LOADING WASTE CONTAINERS USING FRONT LOADING WASTE VEHICLES, the full disclosure of which is hereby incorporated by reference.

Overall, adapter systems 12, 212 and 412 enable work vehicle 10 to engage, lift and unload refuse from a multitude of differently configured REL containers and FEL containers. Adapter systems 12 and 212 are configured to be repositioned for engaging either an FEL container or an REL container without requiring that the operator manually reposition any components. Adapter system 412 eliminates the need for actuators to pivot support arms 464 and is thereby less complex, less expensive and easier to maintain. Each of adapter systems 12, 212 and 412 enable a single refuse collection vehicle to engage, lift and unload both REL containers and FEL containers. As a result, adapter systems 12, 212 and 412 eliminate the need for waste-hauling companies to maintain large inventories of both REL and FEL waste vehicles and an equally large inventory of FEL and REL containers.

Adapter systems 12, 212 and 412 are merely exemplary embodiments including multiple distinct advantageous components and features. Although not specifically illustrated, various alternative adapter systems including different combinations of components and features are also contemplated. For example, although adapter system 12, 212 and 412 are each illustrated as being mounted between lift arms 22 of vehicle 10, adapter systems 12, 212 and 412 may alternatively be configured to be mounted to an existing cross support with an alternatively configured vehicle or existing forks of an alternatively configured vehicle. Moreover, adapter system 412 may alternatively include container stop mechanisms 300 in lieu of container stops 467 or may utilize a lock arm 60 providing container stop surface 94 in lieu of container stop 467. Likewise, in lieu of utilizing a powered actuator to pivot support arms 64, systems 12 and 212 may alternatively use an appropriately configured lever arm similar to lever arm 466. Although each of systems 12, 212 and 412 are illustrated as including forks to thereby enable such systems to engage both FEL and REL containers, such forks could be replaced with alternative members not configured to engage the channels of FEL containers but still providing those components necessary to enable systems 12, 212 and 412 to engage REL containers. Although less desirable, such alternative configurations would still enable REL containers to be engaged, lifted and unloaded by a front-loading waste collection vehicle whereby the REL container is lifted over cab 20 and partially inverted in alignment with load-opening 38 of storage body 18.

Although the present invention has been described with reference to preferred embodiments, workers skilled in the art will recognize that changes may be made in form and detail without departing from the spirit and scope of the invention. Because the technology of the present invention is relatively complex, not all changes in the technology are foreseeable. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A refuse collection vehicle for loading refuse from a front loading container having a floor, a front wall, a rear wall, first and second side walls and first and second channels along the first and second side walls and also from a rear loading container having a floor, a front wall, a rear wall, first and second side walls and at least one trunnion extending along an axis and having first and second trunnion end portions extending beyond the first and second side walls, respectively, the vehicle comprising:

a chassis;

a storage body supported by the chassis, the storage body having an interior and a roof above the interior providing an opening into the interior;

first and second lift arms pivotably coupled to one of the chassis and the storage body;

a cross member extending between the first and second lift arms;

first and second forks extending from the cross member and configured to be positioned within the first and second channels;

at least one support arm configured to engage the rear wall of the rear loading container;

at least one movable surface adapted for movement between a trunnion encircling position and a trunnion non-encircling position; and at least one movable container stop surface adapted for movement between an extended position in which the stop surface engages an upper edge of one of the first and second side walls of the rear loading container and a retracted position so as to permit the first and second forks to be positioned within the first and second channels.

2. The vehicle of claim 1, wherein the at least one movable surface pivots about an axis parallel to the axis of the at least one trunnion between the encircling position and the non-encircling position.

3. The vehicle of claim 1, wherein the at least one movable surface includes a first surface provided by the first fork and a second surface movable relative to the first surface and wherein the first and second surfaces cooperate to encircle the first trunnion end portion in the trunnion encircling position.

4. The vehicle of claim 3, wherein the first fork includes a channel support and trunnion guide surface extending from the first surface.

5. The vehicle of claim 3, including an arm providing the second surface and at least one moveable container stop surface, wherein the arm pivots to move the second surface to the trunnion encircling position and to move the at least one container stop surface to the extended position.

6. The vehicle of claim 1, wherein the at least one movable surface is adapted for movement along an axis extending between the first and second lift arms to move the at least one movable surface between the trunnion encircling position and the trunnion non-encircling position.

7. The vehicle of claim 1 including at least one actuator coupled to the at least one movable surface to move the at least one movable surface between the trunnion encircling position and the trunnion non-encircling position.

8. The vehicle of claim 1, wherein the at least one movable surface which pivots about an axis extending between the first and second lift arms.

9. The vehicle of claim 1, wherein the at least one movable container stop surface pivots about an axis extending between the first and second lift arms.

10. The vehicle of claim 1, wherein the cross member extends along a first axis between the first and second lift arms and wherein the at least one movable container stop surface pivots about a second axis non-parallel to the first axis between the extended position and the retracted position.

11. The vehicle of claim 10, wherein the first fork extends along a third axis and wherein the at least one movable container stop surface pivots about the second axis which extends non-parallel to the third axis.

12. The vehicle of claim 1, wherein the at least one movable container stop surface extends from the first fork.

13. The vehicle of claim 12, wherein the at least one movable container stop surface is removably mounted to the first fork.

14. The vehicle of claim 1, wherein the first and second forks pivot about an axis extending between the first and second lift arms and wherein the at least one movable container stop surface extends from the first fork such that the at least one movable container stop surface pivots about the axis with the first fork.

15. The vehicle of claim 1 including at least one actuator coupled to the at least one movable container stop surface to move the at least movable container stop surface between the extended position and the retracted position.

16. The vehicle of claim 1 including an actuator coupled to the at least one movable surface and the at least one movable container stop surface, wherein the actuator substantially simultaneously moves the at least one movable surface and the at least one movable container stop surface to the trunnion encircling position and the extended position, respectively.

17. The vehicle of claim 1, wherein the at least one support arm is pivotably supported for rotation about an axis extending between the first and second support arms so as to pivot between a container-engaging position and a retracted position.

18. The vehicle of claim 17 including an actuator coupled to the at least one support arm and configured to move the at least one support arm between the container-engaging position and the retracted position.

19. The vehicle of claim 17 including a lever arm coupled to the at least one support arm, wherein the lever arm is configured to be engaged by the at least one trunnion or the rear wall of the rear loading container so as to pivot the at least one support arm from the retracted position to the container-engaging position.

20. The vehicle of claim 1, wherein the first and second forks and the at least one support arm are movable between an extended position in which the first and second fork and the at least one support arm extend perpendicular to the first and second lift arms and a collapsed position in which the first and second forks and the at least one support arm extend parallel to the first and second lift arms.

21. A refuse collection vehicle for loading refuse from a front loading container having a floor, a front wall, a rear wall, first and second side walls and first and second channels along the first and second side walls and also from a rear loading container having a floor, a front wall, a rear wall, first and second side walls and at least one trunnion having first and second trunnion end portions extending beyond the first and second side walls, the vehicle comprising:

a chassis;

a storage body supported by the chassis, a storage body having an interior and a roof above the interior providing an opening into the interior;

first and second lift arms pivotably coupled to one of the chassis and the storage body;

a loader adapter coupled to the first and second lift arms and including:

first and second forks;

first and second trunnion encircling mechanisms;

at least one support arm; and at least one container stop, the loader adapter being configured to move between a front loader position in which the adapter is adapted to engage the front loading container and a rear loader position in which the adapter is adapted to engage the rear loading container, wherein, in the front loader position, the first and second forks are adapted to be disposed in the first and second channels and wherein, in the rear loader position, the first and second encircling members are adapted to encircle the first and second trunnion end portions, the support arm is adapted to engage the rear wall of the rear loading container and the at least one container stop is adapted to engage an upper edge of at least one of the first and second side walls of the rear loading container.

22. The vehicle of claim 21, wherein the trunnion encircling mechanism includes the first and second members, wherein at least one of the first and second members pivots about an axis parallel to an axis of the at least one trunnion between the encircling position and the non-encircling position.

23. The vehicle of claim 22, wherein the second member carries the container stop and wherein the container stop engages the upper edge of said one of the first and second side walls of the rear loading container when the first and second members are in the encircling positions.

24. The vehicle of claim 21, wherein the trunnion encircling mechanism includes:

a movable member having an opening therethrough, wherein the member is movable along an axis parallel to the axis of the trunnion between the encircling position in which the opening receives the trunnion and the non-encircling position.

25. The vehicle of claim 21, wherein the container stop pivots about an axis parallel to the at least one trunnion between the encircling and the non-encircling positions.

26. The vehicle of claim 21, wherein the container stop pivots about an axis non-parallel to the axis of the at least one trunnion between the encircling position and the non-encircling position.

27. The vehicle of claim 21, wherein the container stop moves along an axis parallel to the axis of the at least one trunnion between the encircling position and the non-encircling position.

28. The vehicle of claim 21 wherein the at least one support arm is pivotable about an axis extending between the first and second lift arms, whereby the at least one support arm is adapted to engage the rear wall of the front loading container and the rear loading container.

29. The vehicle of claim 21 wherein the first and second forks and the at least one support arm are movable between an extended position in which the first and second forks and the support arm extend perpendicular to the lift arms and a collapsed position in which the first and second forks and the at least one support arm extend parallel to the lift arms.

30. An adapter for use with a refuse collection vehicle for loading refuse from the container having a floor, a front wall, a rear wall, first and second side walls, and at least one trunnion having first and second trunnion end portions extending beyond the first and second side walls, respectively, the vehicle having a chassis, a storage body supported by the chassis and including an interior with a roof above the interior providing an opening into the interior and first and second lift arms pivotably coupled to one of the chassis and the storage body, the adapter comprising:

a cross member configured to be coupled to the first and second lift arms between the first and second lift arms;

first and second forks extending from the cross member;

at least one support arm supported by the cross member and configured for pivotable movement between a container-engaging position in which the at least one support arm is adapted to engage the rear wall of the container and a retracted position;

at least one movable surface supported by the cross member and adapted for movement between a trunnion encircling position and a trunnion non-encircling position; and at least one movable container stop surface supported by the cross member and configured to engage an upper edge of one of the first and second side walls of the container.

31. The adapter of claim 30, wherein the at least movable container stop surface pivots between a container-engaging position in which the at least one movable container stop surface is adapted to engage the upper edge of one of the first and second side walls of the container and a retracted position.

32. A refuse collection vehicle for loading refuse from a container having a floor, a front wall, a rear wall, first and second side walls having first and second upper edges, respectively, and at least one trunnion proximate the rear wall, the trunnion having first and second end portions extending beyond the first and second side walls, respectively, the vehicle comprising:

a chassis;

a storage body supported by the chassis;

first and second lift arms pivotably coupled to one of the chassis and the storage body;

a cross member extending between the first and second lift arms;

first and second forks extending from the cross member;

at least one support arm configured to engage the rear wall of the container;

at least one movable member adapted for movement between a first trunnion encircling position and a second trunnion non-encircling position; and at least one container stabilizer extending from the cross member and configured to engage at least one of the upper edge of the first side wall, the upper edge of the second side wall and the front wall.

33. A method of picking up and emptying a refuse container having a floor, a front wall, a rear wall, first and second side walls having first and second upper edges, respectively, and at least one trunnion having first and second end portions extending beyond the first and second side walls, respectively, the method comprising:

providing a refuse collection vehicle having a cab, at least one waste collection compartment having a roof with a load opening therethrough, a lifting assembly including a cross member connected to hydraulic arms, at least one movable member adapted for movement between a first trunnion encircling position and a second trunnion non-encircling position, at least one support arm configured to engage the rear wall of the container and at least one movable container stop adapted for movement between a retracted position and an extended position in which the stop engages at least one of the upper edge of the first side wall, the upper edge of the second side wall and the front wall;

moving the at least one movable member to the first trunnion encircling position;

moving the at least one support arm into engagement with the rear wall of the container;

moving the at least one container stop into engagement with at least one of the upper edge of the first side wall, the upper edge of the second side wall and the front wall of the container; and pivoting the hydraulic arms to lift the container over the cab and to at least partially invert the container over the roof of the waste collection compartment in at least partial alignment with the load opening.

* * * * *